United States Patent [19]

Sharp et al.

[11] Patent Number: 4,706,553

[45] Date of Patent: Nov. 17, 1987

[54] FUME HOOD CONTROLLER

[75] Inventors: Gordon P. Sharp, Newton; William P. Curtiss, Winthrop; George B. Yundt, Cambridge, all of Mass.

[73] Assignee: Phoenix Controls Corp., Boston, Mass.

[21] Appl. No.: 732,205

[22] Filed: May 8, 1985

Related U.S. Application Data

[63] Continuation-in-part of Ser. No. 586,007, Mar. 5, 1984, Pat. No. 4,528,898.

[51] Int. Cl.[4] ..... B08B 15/02

[52] U.S. Cl. ..... 98/115.3

[58] Field of Search ..... 98/1.5, 115.1, 115.3; 236/49

[56] References Cited

U.S. PATENT DOCUMENTS 4,031,819 6/1977 Applewhite ..... 98/115
4,150,606 4/1979 Nelson ..... 98/115.3
4,160,407 7/1979 Duym ..... 98/115.3
4,517,883 5/1985 Levchenko et al. ..... 98/115.3

FOREIGN PATENT DOCUMENTS 2076145 11/1981 United Kingdom ..... 98/115.3

*Primary Examiner*—Harold Joyce
*Attorney, Agent, or Firm*—Wolf, Greenfield & Sacks

[57] ABSTRACT

A fume hood controller system in which the sash position is monitored by a transducer which provides a signal indicative of the area of the hood opening. A variable speed motor controller is responsive to the sash position signal to provide a fan speed which varies in a substantially continuous and linear manner as a function of the sash opening. In an alternate embodiment, the air flow through the hood is controlled by a damper or similar device. Several embodiments are shown in which the present invention may be used to control a fume hood system in which a blower exhausts a plurality of fume hoods while maintaining a substantially constant face velocity in each hood.

26 Claims, 24 Drawing Figures

FUME HOOD CONTROLLER

This application is a continuation-in-part of U.S. patent application Ser. No. 586,007, filed Mar. 5, 1984, now U.S. Pat. No. 4,528,898, for a Fume Hood Controller.

FIELD OF THE INVENTION

This invention is related to laboratory fume hoods, and more specifically to controllers for maintaining a constant face velocity in a fume hood as the sash is raised and lowered.

BACKGROUND OF THE INVENTION

A laboratory fume hood is a ventilated enclosure where harmful materials can be handled safely. The hood captures contaminants and prevents them from escaping into the laboratory by using an exhaust blower to draw air and contaminants in and around the hood's work area away from the operator so that inhalation of and contact with the contaminants are minimized. Access to the interior of the hood is through an opening which is closed with a sash which typically slides up and down to vary the opening into the hood.

The velocity of the air flow through the hood opening is called the face velocity. The more hazardous the material being handled, the higher the recommended face velocity, and guidelines have been established relating face velocity to toxicity. Typical minimum face velocities for laboratory fume hoods are 75 to 150 feet per minute (fpm), depending upon the application.

When an operator is working in the hood, the sash is opened to allow free access to the materials inside. The sash may be opened partially or fully, depending on the operations to be performed in the hood. While fume hood and sash sizes vary, the opening provided by a fully opened sash is on the order of ten square feet. Thus the maximum air flow which the blower must provide is typically on the order of 750 to 1500 cubic feet per minute (cfm).

The sash is closed when the hood is not being used by an operator. It is common to store hazardous materials inside the hood when the hood is not in use, and a positive airflow must therefore be maintained to exhaust contaminants from such materials even when the hood is not in use and the sash is closed.

It is important that the face velocity be kept as constant as possible. The minimum acceptable face velocity is determined by the level of hazard of the materials being handled, as discussed above. Too high a face velocity may cause turbulence, however, which can result in contaminants escaping from the hood. Additionally, high face velocities can be annoying to the operator and can damage fragile apparatus in the hood. As the hazard level of the materials being handled and the resulting minimum face velocity increases, maintaining a safe face velocity becomes more difficult.

Another important consideration in the design of a fume hood system is the cost of running the system. There are three major areas of costs: the capital expenditure of installing the hood, the cost of power to operate the hood exhaust blower, and the cost of heating, cooling, and delivering the "make-up air," which replaces the air exhausted from a room by the fume hood. For a hood operating continuously with an opening of 10 square feet and a face velocity of 100 fpm, the cost of heating and cooling the make-up air, for example, could run as high as fifteen hundred dollars per year in the northeastern United States. Where chemical work is done, large numbers of fume hoods may be required. For example, the Massachusetts Institute of Technology has approximately 650 fume hoods, most of which are in operation 24 hours per day.

Reliability is another important factor in the design of a fume hood system. It is important that the face velocity of a fume hood not be allowed to go below a certain level. The amount of air being exhausted from a hood may be decreased by many common occurrences; duct blockage, fan belt slippage or breakage, deterioration of the blower blades, especially where corrosive materials are being handled, motor overload, and other factors. A reduction in air flow reduces the face velocity, and it is important to take immediate steps when a low flow condition occurs to prevent escape of contaminants from the hood.

A conventional fume hood consists of an enclosure which forms five sides of the hood and a hood sash which slides up and down to provide a variablesized opening on the sixth side. In this type of hood, the amount of air exhausted by the hood blower is essentially fixed, and the face velocity increases as the area of the sash opening decreases. As a result, the sash must be left open an appreciable amount even when the hood is not being used by an operator to allow air to enter the hood opening at a reasonable velocity.

To maintain a more constant face velocity as the hood sash is moved up and down, so-called "by-pass" hoods have been developed. A by-pass hood has a by-pass opening through which air can enter the fume hood. The by-pass opening is blocked by the sash when it is in the fully opened position. As the sash is lowered, the by-pass opening is gradually uncovered so that air can "by-pass" the hood opening and enter the hood directly, thus preventing the air velocity through the hood opening from becoming too high as the sash is closed.

In known types of fume hoods having a fixed fan speed, the air flow in the hood system may be monitored, for example by means of a flow sensor in the exhaust duct, to determine if the air flow and hence face velocity is below a selected value. It has proven difficult to provide sensors which reliably monitor the performance of a fume hood exhaust system. Air flow sensors are costly and non-linear. They are also subject to contamination by the materials in the exhaust air. Pressure sensors are difficult to use because of the very low pressure drops which can exist in the exhaust ducting if the air flow is varied.

Both conventional and by-pass hoods exhaust a fixed amount of air from the room regardless of sash position. As discussed above, the resulting loss of air from the room can waste a lot of energy. To minimize this loss, so-called "add-air" hoods have been developed. An add-air hood includes an additional blower and duct system which supplies air directly to the front of the hood from outside to provide a portion of the make-up air.

Add-air hoods have not proven to be as successful as might be expected at reducing operating costs. The initial installation expense for such hoods is much higher. Additionally, since the make-up air usually requires conditioning to provide reasonable operator comfort, the heating and cooling costs that are saved are often very modest. Furthermore, many conventional and by-pass hoods installations exist which were installed before the recent dramatic increase in energy prices, and adding the extra ducting and associated equipment required by add-air hoods to existing installations can be extremely expensive.

SUMMARY OF THE INVENTION

Briefly, the present invention includes a fume hood controller system in which the sash position is monitored by a transducer which provides a signal indicative of the area of the hood opening. A variable speed controller is responsive to the sash position signal to provide a fan speed which varies in a substantially continuous and linear manner as a function of the sash opening. In an alternate embodiment, the air flow through the hood is controlled by a damper or similar air control device.

Several alternate embodiments are shown in which the present invention may be used to control a fan hood system in which a single blower exhausts a plurality of fume hoods while maintaining a substantially constant face velocity in each hood.

DESCRIPTION OF THE DRAWINGS

The operation and advantages of the present invention will be more fully understood with reference to the accompanying figures of which.

DESCRIPTION OF THE PREFERRED EMOBIMENT

Figure 1A:
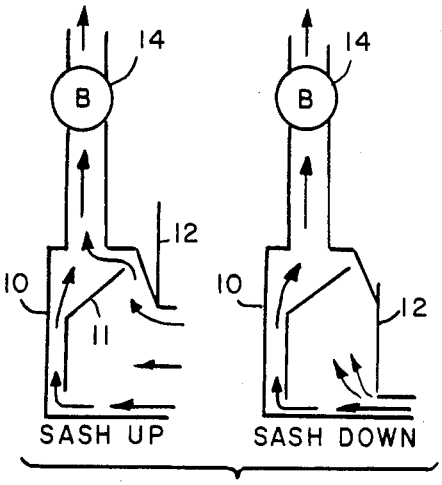
FIGS. 1A, 1B, 1C, and 1D show prior art fume hood systems.

FIGS. 1 show three types of prior art fume hoods. A conventional fume hood is shown in FIG. 1A and essentially consists of an enclosure 10 forming five sides of the hood and a sash 12 which slides up and down to provide a variable-sized opening on the sixth side. A baffle 11 is usually provided to control the air flow inside the hood. Air is exhausted from the hood by a blower and blower motor 14. The blower motor is typically an induction motor, which may be single-phase or three-phase, depending on the particular application, and the motor is normally connected to a centrifugal blower fan via a fan belt drive. In this type of hood, the amount of air exhausted by the hood blower 14 is essentially fixed, and the face velocity increases as the area of the sash opening 14 decreases. As a result, the sash must be left open an appreciable amount or a permanently-open by-pass opening which is not closed when the sash is closed must be provided into the hood.

To avoid increasing the face velocity excessively as the sash is closed, some fume hoods include a two speed motor and a switch which is activated by the sash as it is raised and lowered. When the sash is lowered beyond a selected point, the blower motor is switched to low speed. While this arrangement reduces the variation in face velocity, there is still a significant change in face velocity as the sash is moved.

Figure 1B:
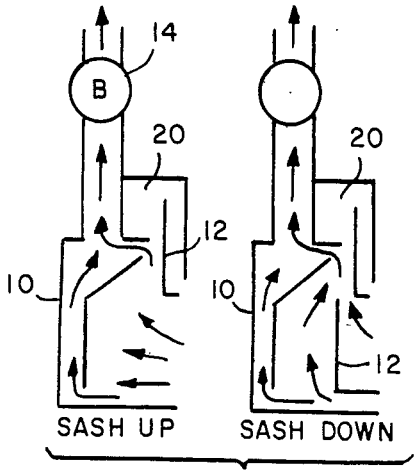
Figure 1C:
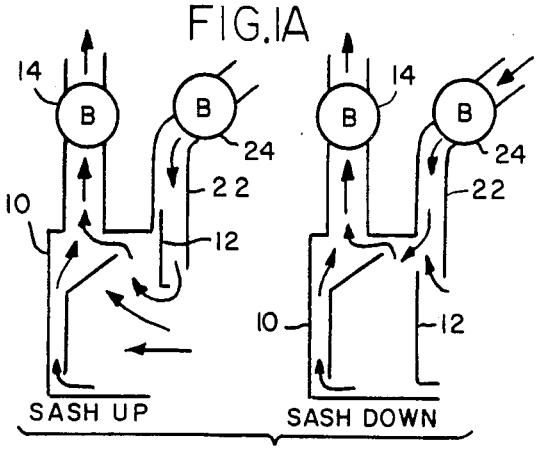

FIG. 1B shows a by pass hood type of fume hood. A by-pass hood has a second opening 20 through which air can enter the exhaust duct. By-pass opening 20 is blocked by the sash when it is in the fully opened position, as shown in FIG. 1B. As the sash is lowered, the by-pass opening is gradually uncovered so that air can "by-pass" the hood opening and enter the exhaust duct directly, thus preventing the face velocity through the sash opening from becoming too high as the sash is closed. FIG. 1C shows an add-air type of hood, which includes a duct 22 and a second blower 24 which supply air from outside to provide a portion of the make-up air.

Figure 1D:
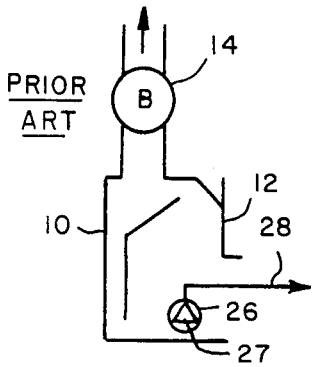

In FIG. 1D, a prior art system is shown in which an air flow sensor 27 is placed in an opening in the fume hood so that it can directly sense the velocity of the air entering the hood. Sensor 27 could be placed in the sash opening or in a separate opening in the side of the hood enclosure 10, as shown by opening 26 in FIG. 1D. In this system, the sensor may be used to control either the blower speed or a damper in the exhaust ducting to control the air flow. As discussed above, this type of system suffers from the expense, nonlinearities, and susceptibility to contamination of the air flow sensor.

Figure 2:
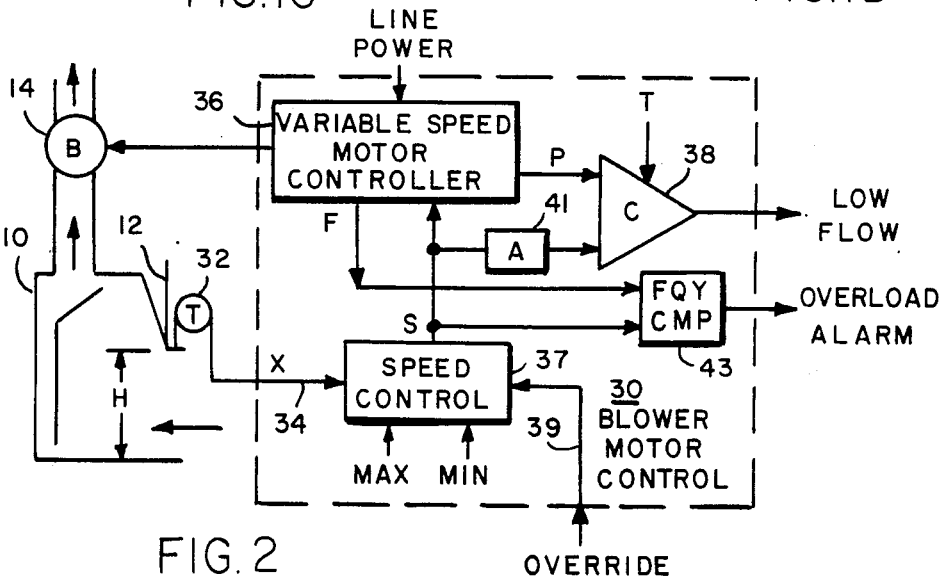
FIG. 2 is a block diagram depicting one embodiment of the present invention.

Referring to FIG. 2, there is shown a block diagram of the present invention as it would be applied to a conventional fume hood. As in conventional hoods, a hood enclosure 10 surrounds the hood working area, and a sash 12 is raised and lowered to provide an opening into the hood. Blower 14 exhausts air from the hood and is controlled by a fume hood controller circuit 30, whose operation will be described below.

The position of sash 12 is monitored by a transducer 32 which provides an output signal x on line 34 which is representative of the hood sash position. In the preferred embodiment described, transducer 32 is implemented by means of a constant tension, spring-return potentiometer, as discussed below. The transducer should provide an output which is a continuous and monotonic function of the sash height, designated as H in FIG. 2. In the preferred embodiment, the transducer provides an output signal X which is proportional to the height H of the sash.

The signal on line 34 is applied to a variable speed motor controller circuit 36 via a speed control circuit 37. In response to the signal from speed control circuit 37, motor controller 36 varies the speed of blower motor 14. Speed control circuit 37 has two inputs, designated as MAX and MIN in FIG. 2, which select the maximum and minimum speeds for the blower motor during normal operation. The MAX and MIN signals may be provided by manually setting potentiometers, although other means may be used. The maximum and minimum speeds are typically selected to provide a range of approximately 15 to 85 percent of the maximum air flow provided by the blower, as discussed in more detail below. As the hood sash 12 is moved up and down, speed control 37 commands the motor controller 36 to vary the blower speed over the selected range. An override signal may also be provided to speed control 37 on line 39. In response, the speed control 37 commands the motor controller to drive blower 14 at maximum speed to provide 100 percent of the maximum air flow. This feature is useful in emergency situations where the hood must be exhausted as rapidly as possible. The override signal may be provided manually or by an automatic sensor which detects a dangerous situation, such as high temperature.

The circuitry described above causes the speed of blower 14 to be varied substantially linearly between the selected minimum and maximum speeds as a function of the sash height H. The fume hood system pressure drop is dominated by the resistance to air flow of the exhaust ducting, and thus appears like a fixed or constant system, until the sash is almost completely closed. Most systems will have a minimum sash opening or a by-pass opening that will set a minimum air flow in the hood to ensure that the hood air is constantly being replaced, and this small opening helps to keep the fixed system assumption valid even for a fully closed sash by keeping the pressure drop across the hood opening small. The fan laws state that for a fixed system, air flow is proportional to fan speed. As a result, the system of FIG. 2 varies the speed of blower 14 so that the air flow from the hood varies linearly as the sash height changes, and thus as the area of the hood opening. In this manner, the face velocity of the air flowing through the hood opening is maintained at an essentially constant value as the sash is raised and lowered.

It is important that the face velocity of a fume hood not be allowed to go below a certain level. A low face velocity may be caused by many conditions, such as a blocked duct or slipping fan belt, and it is important to take immediate steps when a low flow condition exists to prevent escape of contaminants from the hood. In by-pass fume hoods having a fixed fan speed, the air flow in the hood system may be monitored, for example by means of a flow sensor in the exhaust duct, to determine if the air flow and hence face velocity is below a selected value. As discussed above, there are significant reliability problems with the use of such sensors. Furthermore, such systems for monitoring air flow are not readily applicable to the present invention, in which the blower speed and air flow are continuously varied over a wide range.

Centrifugal blowers are characterized by a reduction in the power required as the amount of air moved by the blower decreases for a given fan speed. A blocked duct or other condition which reduces the air flow in the fume hood can be detected by monitoring the power consumed by the blower motor and comparing the power level with an expected power level. Other conditions resulting in a low flow, such as a slipping or broken fan belt, will also reduce the power consumed by the blower motor at a given speed.

As discussed above, for a properly operating system, the blower motor power is proportional to the cube of the fan speed, the pressure drop across the fan is proportional to the square of the fan speed, and the air flow is proportional to the fan speed. Thus to detect a variation from the expected power, the power signal P should be compared with a signal which is proportional to the cube of the speed control signal S. Because of the cubic relationship between power and fan speed, the sensitivity of the circuitry shown in FIG. 2 has a high sensitivity to variations in blower speed. Thus the scaling factor for scaling circuit 41 may be selected to give an adequate margin for such deviations from the theoretical cubic relationship while still maintaining adequate sensitivity to changes in the motor power which indicate a dangerous condition. One means for implementing circuit is shown and described below with reference to FIG. 12.

In FIG. 2, motor controller 36 provides a signal P to one input of a comparator circuit 38 which is proportional to the power being applied to blower motor 14. The speed control signal from circuit 37 is applied through a scaling circuit 41 to a second input of comparator circuit 38. From the discussion above, it can be seen that the blower motor power and the blower fan speed are functionally related to each other. A scaling circuit 41 serves to multiply or scale the speed control signal by a function A which approximates the cubic relationship between fan speed and power. Comparator circuit 38 compares the actual motor power to the speed control signal and provides an output signal when the actual motor power drops below the expected power consumption by a preselected value. A threshold signal T applied to the comparator circuit sets the amount by which the actual power must drop to cause a low flow alarm signal.

The fume hood airflow may also be reduced by conditions which overload the motor or the motor controller. Such conditions include shorted motor leads, reduced drive voltage, excessive bearing friction, or a jammed blower wheel. An overload condition in the motor is indicated by a difference in frequency between the commanded and the actual electrical frequency applied to the motor. The commanded frequency is represented by speed control signal S Motor controller circuit 36 provides a signal, designated as F in FIG. 2, which is representative of the frequency of the AC signals applied to the blower motor. This signal is applied to one input of a comparison circuit 43.

The speed control signal S is applied to a second input to circuit 43. Comparison circuit 43 compares the commanded frequency with the stator excitation frequency, and provides an output signal representative of an overload condition when the diiference frequency exceeds a predetermined value. The above-described operation of the low flow and overload alarm detection circuitry results in a permitted window of operation for the fan motor speed. The circuitry of the present invention detects speeds which are above or below this window and produce an alarm output in response thereto.

Figure 4:
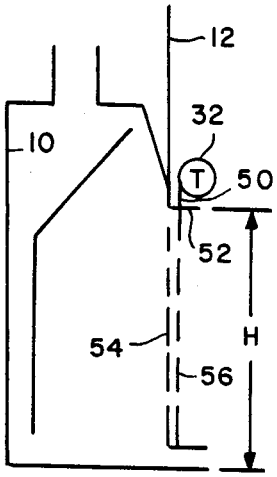
FIG. 4 shows a preferred sash position sensor.

While many different type of transducers may be used with the system of FIG. 2, it has been found that a potentiometer connected to a reel and a constant tension return spring provides a reliable and effective means of indicating sash position. These devices are readily available in materials which are suitable for installation on a fume hood. Additionally, they are particularly suitable to applications in which the fume hood controller of present invention is added to an existing fume hood installation. FIG. 4 shows how such a transducer may be installed.

The transducer includes a potentiometer connected to a reel on which a cable is wound. A constant tension spring provides a return force on the reel. When the cable is extended, it unwinds from the reel, and the potentiometer provides an indication of how far the cable has traveled. Referring to FIG. 4, the potentiometer 32 is installed so that the cable 50 may be attached to the hood sash, as shown at 52. When the hood is lowered, as indicated by dotted line 54 in FIG. 4, the cable unwinds, as indicated by dotted lines 56, varying the resistance of potentiometer 32.

It should be noted that the present invention utilizing the transducer shown in FIG. 4 may be easily retrofitted to existing installations. No major modifications to the fume hood or motor are required. The transducer cable may be easily attached to the hood sash in almost all installations. In most cases, the force exerted on the hood sash by the potentiometer return spring is negligible, and at most, a minor adjustment to the sash counterbalance is needed.

Figure 5:
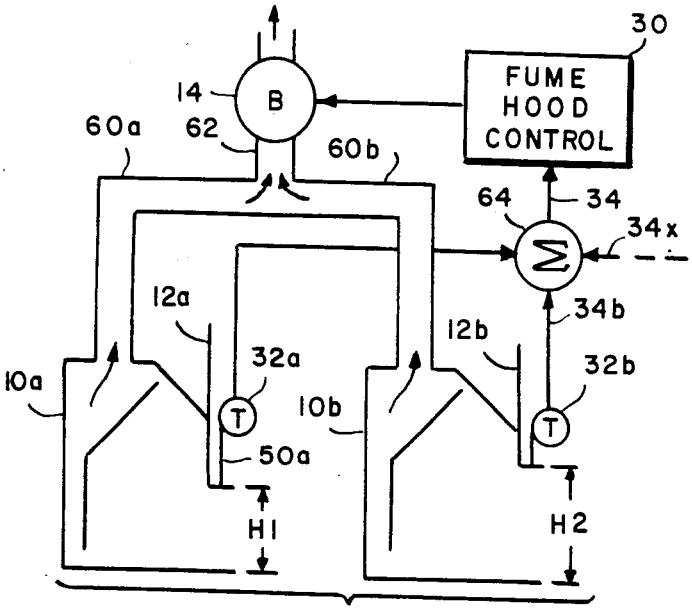
FIG. 5 shows the present invention applied to a fume hood system in which one blower exhausts more than one fume hood.

FIG. 5 shows how the fume hood controller of FIG. 2 may be applied to a fume hood system in which two or more hoods are exhausted through a single blower. In FIG. 5, two fume hoods 10*a* and 10*b* are each connected to respective exhaust ducts 60*a* and 60*b* which, in turn, both feed into a common duct 62 connected to a blower 14. This type of installation is often used in multiple hood installations for economy. Each hood has its own sash position transducer 32*a* and 32*b*. FIG. 5 shows the output signals from transducers 32 being applied on respective lines to a summing circuit 64. The output of summing circuit 64 is equal to the sum of the transducer outputs and, hence, is proportional to the total area of the hood openings. In other words the output signal X from summer 64 is equal to $K_1H_1+K_2H_2$, where $H_1$ and $H_2$ represent the individual sash heights of the two hoods 10*a* and 10*b* and $K_1$ and $K_2$ reflect the width of the hoods. The output signal from summer 64 is applied to the fume hood controller 30 on line 34, as in FIG. 2.

Figure 3A:
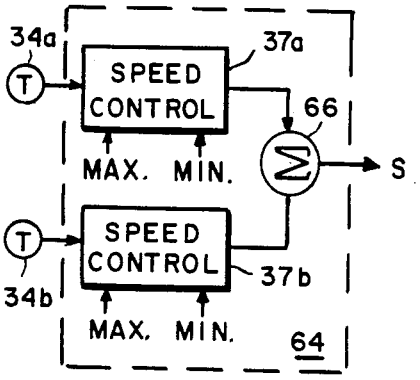
FIG. 3A is a block diagram showing showing how two speed control signals could be combined in a system such as that shown in FIG. 5.

It should be apparent that the signals from transducers 32 may be combined in various ways. The arrangement of FIG. 5 may be extended to more than two fume hoods, as indicated by dotted line 34*x* which represents sash height signals from one or more other hoods. It is preferrable that the signals from each of the hoods should be summed after the processing of the sash signal by speed control 37. This is shown in FIG. 3A in which the output signals from transducers 34*a* and 34*b* are respectively processed by associated speed control circuits 37*a* and 37*b* before being summed in summing circuit 66 to provide the speed control signal S applied to the blower motor controller.

Figure 3B:
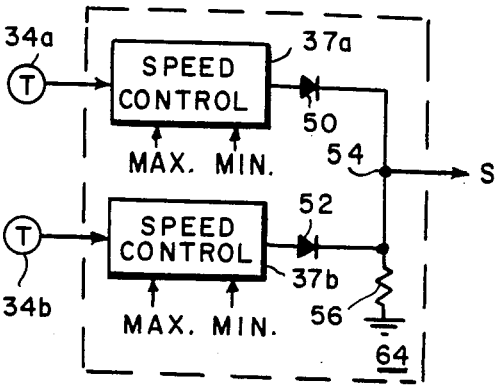
FIG. 3B shows an alternate circuit for combining speed control signals where ganged fume hoods are used.

An alternate method of combining the speed control signals is to make the combined speed control signal equal to the largest of the individual speed control signals from each of the hoods. FIG. 3B shows one circuit for selecting the largest speed control signal to be applied to the motor drive circuit. In FIG. 3B, the speed control signals provided by speed control circuits 37*a* and 37*b* are applied to a common node 54 via diodes 50 and 52 to provide a combined signal across a resistor 56 whose resistance is much greater than the output impedances of the speed control circuits 37. In a system with more than two hoods, additional speed control signals from the additional hoods may be applied to node 54 through individual diodes to provide the combined signal. The signal at node 54 is equal to the largest of the speed control signals from the speed control circuits, less a diode drop. The diode drop may be compensated for by appropriately adjusting the turndown offset control discussed below.

The method of FIG. 3B for providing a combined speed control signal has advantages in some situations where multiple hoods are connected to a single exhaust hood. When multiple hoods are connected to a common exhaust duct, such as shown in FIG. 5, if the pressure drop across the sash is much less than pressure drops elsewhere in the system, the flow distribution between multiple hoods may not change as one of the sashes is lowered. This problem is discussed further below. In such a situtation, lowering the sash of one of the hoods merely decreases the face velocity of the other hood, since the flow of both hoods will decrease similarly when the motor speed is decreased. In fact, this will be the case in most situations, since most of the pressure drop in most hood installations is caused by flow restrictions other than the sash opening. With a circuit such as shown in FIG. 3B, the flow of the system is only decreased when both sashes are lowered below a given position. Although a face velocity above the optimum may result in the hood with the lower sash, the face velocity will always be above a predetermined level for all conditions and the safety of the system is ensured.

Many different types of blower or motor speed controllers may be used with advantage in the present invention. One type of motor controller circuit which is suitable for use with the present invention and which has advantages over some other types of motor controller circuits is the Self Generative Variable Speed Induction Motor Drive described in U.S. Pat. No. 4,400,655, by William Curtiss and Gordon Sharp, issued Aug. 23, 1983, the contents of which are incorporated herein by reference.

Figure 6:
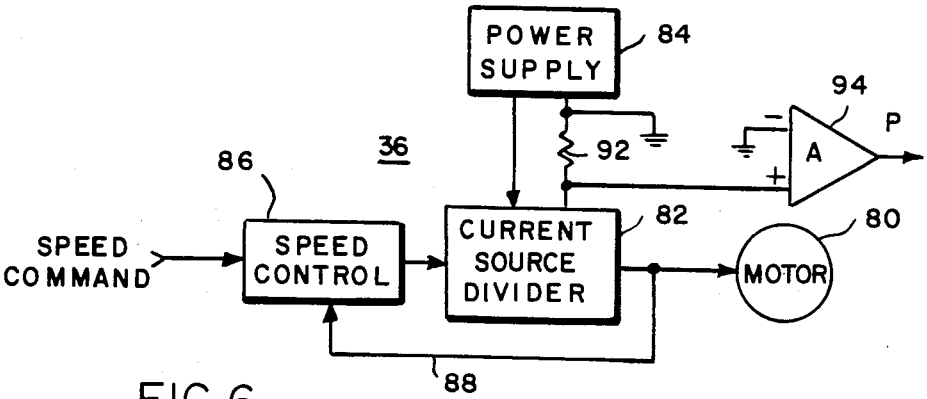
FIG. 6 illustrates a preferred method of deriving the blower power signal.

The above-referenced patent describes a variable speed motor controller which is a current-source type of drive, as opposed to a voltage-source type of drive. The following is a brief description of current-source motor controller with reference to FIG. 6, which shows a generalized block diagram of this type of controller. In FIG. 6, the stator windings of a three-phase motor 80 are driven by a current source driver circuit 82. Power to the motor is supplied by a power supply circuit 84 via driver circuit 82. The motor driver circuit is a switching type of circuit and dissipates little power. The frequency of the signals applied to the stator windings, which is closely related to motor speed, is determined by speed control circuitry 86. The instantaneous electrical excitation frequency is self generated from the voltage produced across the stator windings. This frequency is monitored and fed back on line 88 to the speed control circuitry 86 where it is compared with the desired speed, and the amplified error is used to control the drive current amplitude applied to the stator windings. In this manner closed loop control of the motor speed is provided. A speed command signal is applied to the speed control circuitry 86 on line 90. In the present invention, the speed control signal on line 90 is the output signal from speed control circuit 37 shown in FIG. 2.

Using a motor controller such as that shown in FIG. 6 with the present invention has several advantages over some other types of controllers. First, the controller of FIG. 6 provides closed-loop control of the motor speed without requiring a tachometer or other separate speed sensor attached to the motor. This increases the reliability of the fume hood controller, since a separate motor speed sensor may deteriorate in the environment of fume hood contaminants. Additionally, the fume hood controller may be added to an existing fume hood system without the necessity of adding a motor speed sensor.

Second, the power signal P in FIG. 2 may be easily derived from the control circuit of FIG. 6. Induction motors frequently operate with large power factors. As a result, the power applied to a motor may not be equal to the product of the stator voltage and current, and providing a signal representative of the power actually dissipated in the motor is difficult to do from the stator winding waveforms. Since the motor driver circuit dissipates little power itself, the motor power may determined by measuring the power into the driver circuit 82. In the motor controller shown in FIG. 6, the input to driver circuit 82 from the supply 84 is a variable current at a substantially constant voltage. By measuring the average current supplied to the driver circuit, a signal proportional to the actual motor power dissipation can be easily derived. In the embodiment described, the current is measured by means of a small resistor 92 in the return lead to the power supply. The average voltage drop across resistor 92 is proportional to the average current supplied to the motor driver circuit 82, and hence to the average motor power. The voltage across resistor 92 is amplified by a buffer/filter amplifier 94 to provide the power signal P of FIG. 2.

The fume hood controller shown in FIG. 2 may be used with various types of motor controller circuits other than that shown in FIG. 6, including controllers for both single-phase and three-phase induction motors. The selection of an appropriate circuit and the application of the present invention to such circuits is within the ordinary skill of those in the art, and the designation of a preferred type of motor controller herein should not be construed as a limitation on the present invention.

Figure 7:
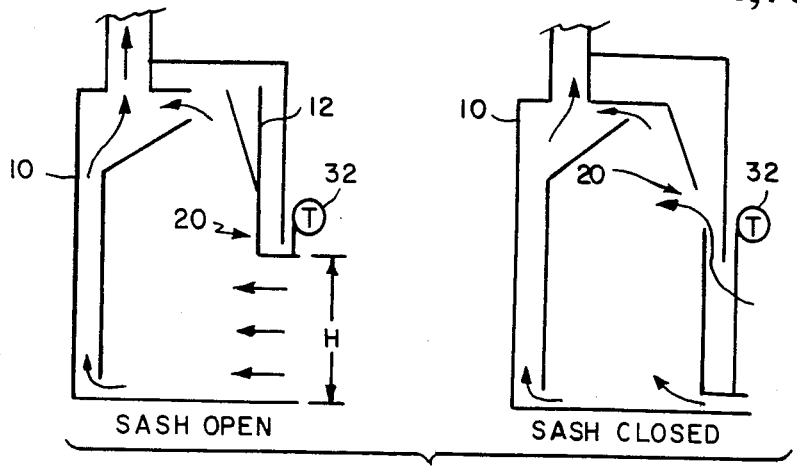
FIG. 7 shows the invention used with a by-pass type of hood.

Referring to FIG. 7 an alternate embodiment of the invention is shown which is suitable where it is desirable to have some by-pass air into the fume hood when the sash is down. In FIG. 7, a fume hood 10 has a by-pass opening 20 which is covered by the sash when it is up. In contrast with conventional by-pass hoods, the by-pass opening does not start to become uncovered until the sash is almost completely closed. A typical system might have the by-pass start to become effective when the sash is eighty percent down. In other words, the by-pass is eliminated from the system after the hood sash has been raised by 20 percent of its total travel.

Figure 8:
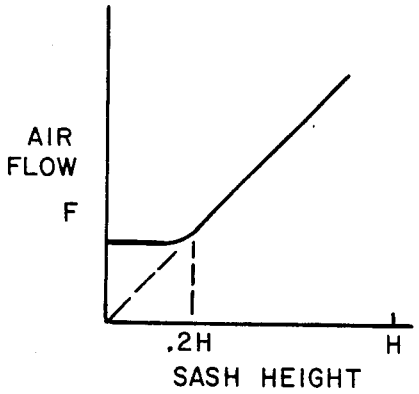
FIG. 8 is a graph showing air flow versus sash height for the system shown in FIG. 7.

The air flow versus sash height curve for the system of FIG. 7 is shown in FIG. 8. If the maximum sash height is designated as H, as shown in FIGS. 7 and 8, the air flow to maintain a constant face velocity is a linear function of sash height for the range 0.2 H to H. Through this range the fume hood controller operates in the same manner as described above in connection with FIG. 2. The blower motor speed is proportional to sash height and to the output of speed control 37. As the hood is lowered below 0.2 H, the air flow should level off to a constant value, as shown in FIG. 8, in order to keep a constant face velocity. This airflow control is accomplished by appropriately setting speed control 37 of FIGS. 2 or 10. In general, the ratio of the bypass area to the total area of the hood opening must be matched to the ratio of the minimum flow desired to the maximum flow desired to keep a constant face velocity. In some cases it may be desirable to design the fume hood so that the bypass area can be easily adjusted to match these ratios once the minimum and maximum flows have been picked.

An alternate, though less energy efficient, bypass arrangement is one where there is a fixed bypass opening, i.e., an opening into the hood having a constant area which does not vary as the sash is moved. Such a fixed bypass may be used with or without a modulated bypass of the type discussed above in connection with FIGS. 7 and 8. In either case,, the invention can still be used to achieve a constant face velocity by adjusting the characteristics of speed control 37 so that the fan speed and thus the air flow is varied roughly proportionally to the total area of all the hood openings, including sash opening, fixed openings or bypasses, and modulated bypasses.

Figure 9:
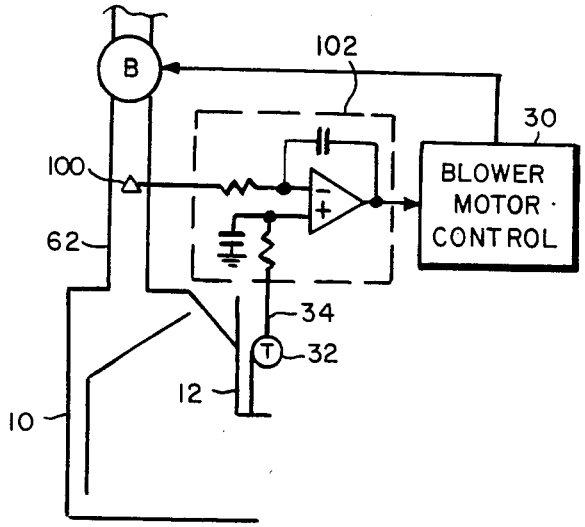
FIG. 9 shows a modification of the transducer circuit which is used with a by-pass system such as that shown in FIG. 7.

The operation of the embodiment of the present invention described in connection with FIG. 2 above depends upon a relatively linear relationship between the blower motor speed and the air flow. This relationship holds true only if the pressure difference between the hood interior and the building exterior remains solely a function of the hood air flow. In some applications, this may not hold true. One example of such an application is where there is a significant negative pressure drop form outside to inside a building caused by many operating fume hoods and an insufficient make-up air supply. This situation would produce a back pressure that would reduce air flow when the pressure drop of the fan becomes comparable to the back pressure, as might be the case for low fan speeds. FIG. 9 shows an alternate embodiment of the present invention which compensates for such a situation.

In FIG. 9, the exhaust air flow is monitored by an air flow sensor 100 located in the exhaust duct, and a signal representative of the air flow is applied to one input of a circuit such as a differential integrator circuit 102. The output signal from transducer 32, which is representative of the desired air flow is applied to the second input to integrator 102. The output of integrator 102 is applied to the blower motor control circuit 30 in place of the transducer output signal X of FIG. 2. The operation of integrator 52 produces an integrator output signal which will cause the blower motor control circuit to increase the blower motor speed until the output signal from air flow sensor 100 equals the output signal from transducer 32, or, in other words, until the actual air flow equals the desired air flow.

Figure 10A:
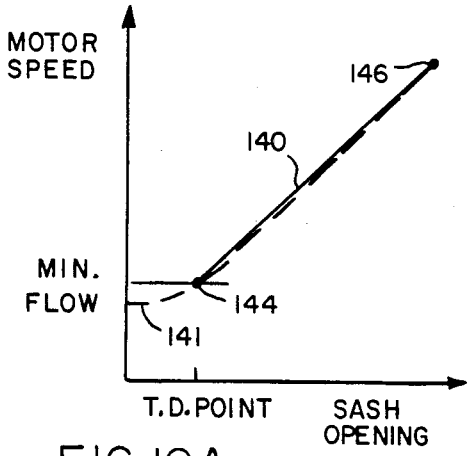
FIG. 10A is a graph of air flow versus sash opening for the system of FIG. 10.
Figure 10:
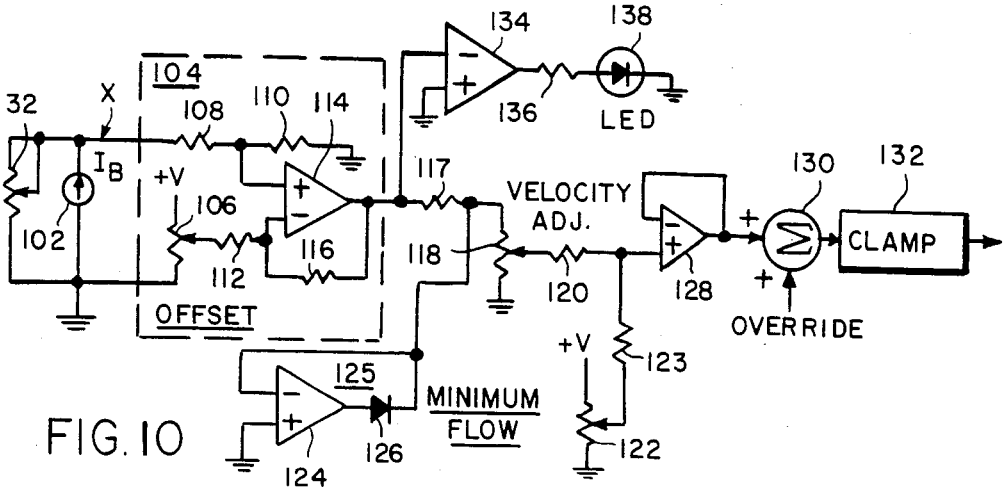
FIG. 10 shows one circuit for implementing the speed control circuit of FIG. 2.

Referring to FIG. 10, there is shown a preferred means of implementing speed control circuit 37. In FIG. 10, a transducer 32 includes a potentiometer wired as a variable resistance. Transducer 32 is driven by a current source 102 to provide a voltage across the transducer terminals which varies linearly with the sash opening. The voltage across transducer 32 is applied to the input of an amplifier circuit 104. The input impedance of amplifier 104 is sufficiently larger than the maximum resistance of the transducer that negligible current is drawn from current source 102. Amplifier 104 includes a turndown point offset adjustment to add a bias to the output voltage. In amplifier 104, this is accomplished by referencing the inverting input of op-amp 114 to a voltage which may be varied between ground and a preselected positive voltage by a adjustable potentiometer 106. The offset adjustment is explained below. The output signal from amplifier 104 is applied to the inverting input of an op-amp 134. The non-inverting input of op-amp 134 is grounded, and the output is connected to ground through series connected resistor 136 and LED 138. Op-amp 134 is operated in open-loop mode and has a very high gain. As the output from amplifier 104 goes from a negative to a positive voltage, LED 138 is switched on and off, providing an indication of when the output signal from amplifier 104 is at zero volts. This is used in the set-up procedure described below.

The output signal from amplifier circuit 104 is applied via a resistor 117 to one end of a potentiometer 118. The other end of potentiometer 118 is connected to ground. By varying the setting of potentiometer 118, the effective gain of amplifier 104 may be adjusted. Potentiometer 118 provides a face velocity adjustment by which the maximum flow through the sash opening may be adjusted, as described below.

A clamp circuit 125 is connected to the junction of resistor 117 and potentiometer 118. Clamp circuit 125 includes an op-amp 124 whose non-inverting input is grounded. The output of the op-amp is connected to its inverting input and to buffer 128 through a diode 126. Clamp circuit 125 ensures that the voltage applied to potentiometer 118 does not go below zero.

The signal from the wiper of potentiometer 118 is applied via a resistor 120 to the non-inverting input of an op-amp 128 which has its output connected to its inverting input to form a unity gain buffer. A minimum flow adjustment is provided by the connection of the wiper of a potentiometer 122. Potentiometer 122 is connected between +V and ground and has its wiper connected to the non-inverting input of op-amp 128 via a resistor 123. The signal from potentiometer 122 is effectively summed with the signal from amplifier 104 at the input to op-amp 128, providing a minimum flow adjustment, as described below.

The output of buffer 128 is summed with the override signal in a summing circuit 130. The output of summing circuit 130 is applied to clamp circuit 132 which limits the output signal S to less than a predetermined voltage level. The override signal is large enough to cause the output of summing circuit 130 to exceed the clamp voltage so that the speed control signal S goes to its maximum value when the override signal is present.

The ratio between the minimum air flow and the maximum air flow through the sash is the "turndown ratio." This is the ratio between the air flow with the sash fully raised to the minimum air flow selected by the minimum flow potentiometer 122 and is typically between aproximately 3 and 5. The sash turndown position or turndown point is defined as a sash opening equal to the maximum opening divided by the turndown ratio. Thus, if a hood has a turndown ratio of 5, the sash turndown position is a sash opening of 20% of the maximum.

A preferred method of adjusting the speed control of FIG. 10 is as follows. The sash is first moved to the turndown point. The turndown offset adjustment of FIG. 10 is then adjusted to give an output of zero volts from op-amp 114, as indicated by the output from LED 138. The minimum flow adjustment is then adjusted to give the the desired face velocity, as measured with a flow meter. Next the sash is raised to its maximum height, and the velocity adjust control is set to provide the desired face velocity at the fully open position.

FIG. 10A is a graph illustrating the operation of the circuit of FIG. 10. The motor speed control signal S, representative of the desired air flow, is shown as a function of the linear sash opening signal by line 140. Dashed line 141 represents the optimum curve of motor speed versus sash opening. This curve is nonlinear at low motor speeds due to backpressure and nonlinear fan characteristics, which nonlinearities become more significant at low motor speeds as discussed in more detail below. The above-described procedure allows a hood operator to quickly and easily set up a fume hood by setting the fume hood flow at the turndown point, point 144 in FIG. 10A, and the fully open point, point 146 in FIG. 10A. The two section approximation to the optimum curve provided by the circuit of FIG. 10 ensures safety by maintaining the motor speed at or above the optimum flow curve at all points so that the face velocity will not drop below the desired minimum level. This becomes more important in applications where there is significant building backpressure which might otherwise cause reduction or reversal of the air flow through the sash opening, as discussed in more detail below.

Figure 11:
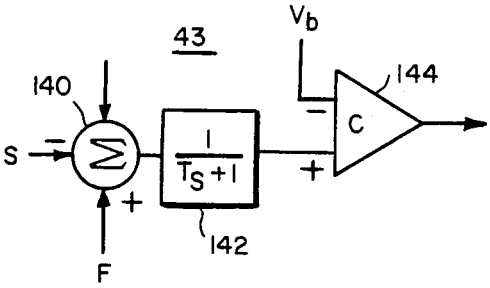
FIG. 11 shows one circuit for implementing the frequency comparison circuit of FIG. 2.

FIG. 11 shows one circuit for implementing the frequency comparator circuit 43 of FIG. 2. The S signal, representing the desired fan speed, and the F signal, representing the actual fan speed, are applied to a difference circuit 140. The output of difference circuit 140 represents the instantaneous difference between the F and S signals and is applied to a filter circuit 142. Filter circuit 142 is a low pas filter with a time constant on the order of several seconds and may be implemented, for example, by the lag network shown in FIG. 11. The output of filter 142 is applied to one input of a comparator circuit 144. The other input to comparator circuit a reference voltage $V_b$ which sets the frequency difference required to produce an alarm signal. The low pass filter 142 has a time constant sufficiently long so that the overload alarm is not triggered by transient errors in the commanded and actual frequencies of the motor. Such a transient error would occur, for example, when the sash is suddenly lifted and blower motor is suddenly commanded to increase the blower speed.

Figure 12:
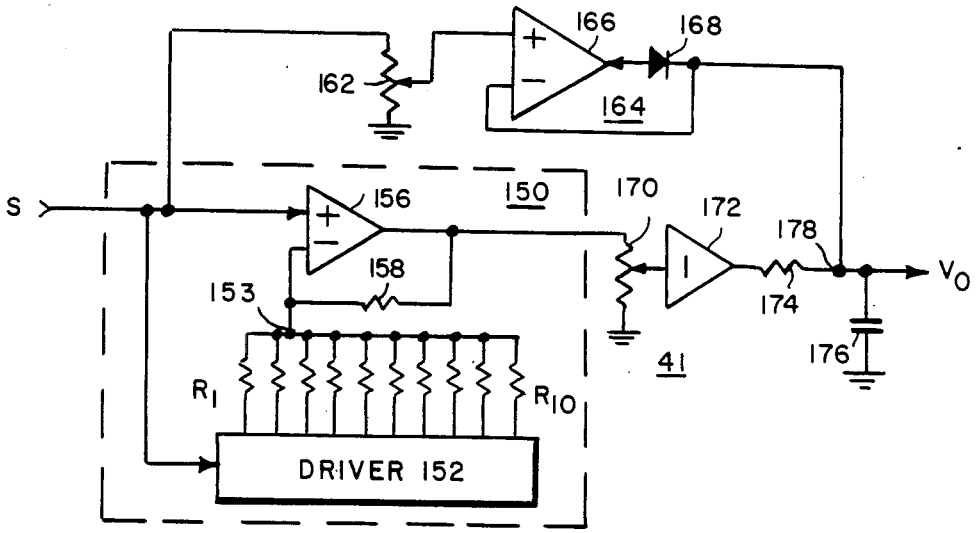
FIG. 12 shows one circuit for implementing the scaling circuit of FIG. 2.

As discussed above, the relationship between fan speed and power is cubic, and a circuit such as circuit 41 in FIG. 2 is necessary to provide a signal which is representative of the cube of the commanded speed. In actual practice, at very low fan speeds, the losses inherent in the motor drive circuit, motor and fan bearings, and the belt drive exceed the power required to drive the fan. These losses are roughly proportional to the motor speed. As the fan speed increases, the power drawn by the blower motor changes from a linear function of motor speed to a cubic function. FIG. 12 shows one circuit by which such a transfer function can be realized.

In FIG. 12, the input voltage S is applied to the input of a circuit 150 which produces an output voltage which is related to the input voltage by a cubic function. There are many circuits known to those in the art for realizing such circuits. In FIG. 12, circuit 150 is implemented as a piecewise-linear approximation of a cubic function in the following manner. The S signal is applied to the input of a display driver circuit 152, such as a National Semiconductor LM3914. Ten resistors R1 through R10 each have one end connected to driver circuit 152 and their other ends are connected together at node 153. As the input signal to driver circuit 152 increases, resistors R1 through R10 are successively connected to ground.

The S signal is also applied to the non-inverting input of an op-amp 156. The inverting input of op amp 156 is connected to its output via resistor 158, and the inverting input is also connected to resistors Rl through R10 at node 153. The effective resistance between node 153 and ground is determined by the values of R1 through R10 and by the operation of driver circuit 152 which selectively connects R1 through R10 to ground. Since R1 through R10 are in the feedback path of op-amp 156, they determine the gain of circuit 150. By choosing the proper values for resistors R1 through R10, a cubic relationship between the input and output voltages of circuit 150 may be easily achieved.

The output signal from circuit is applied to the input of a unity-gain buffer amplifier 172 via a potentiometer 170. potentiometer 170 effectively varies the gain through circuit 150. The output of buffer 172 is applied via a resistor 174 to node 178 from which the output signal $V_o$ is taken. A capacitor 176 is connected between node 178 and ground. The RC network 174–176 serves to filter out any transients which may be produced by the operation of driver circuit 152.

The S input signal is also applied via a potentiometer 162 to clamp circuit 164. Clamp 164 is made up of op-amp 166 and diode 168 connected in the forward conducting direction between the output and the inverting input of op-amp 166. The output of clamp circuit 164 is applied to the output node 178. The clamp circuit operates similarly to clamp circuit 125 described above in reference to FIG. 10, with the exception that the input to clamp circuit 164 is the S signal, rather than a fixed reference voltage. Thus the output from clamp 164 operates to keep the output signal $V_o$ at or above a level which is proportional to the input signal, the proportionality constant being determined by potentiometer 162. As will be seen below, by changing the setting of potentiometer 162, circuit 41 may be adjusted to properly represent the friction and other losses which predominate at low speed and which are proportional to motor speed.

Figure 13:
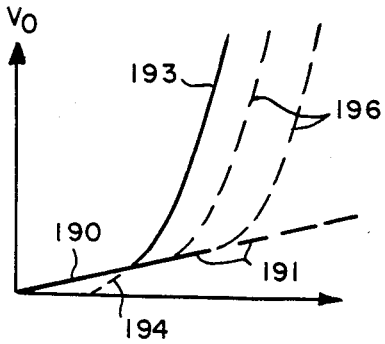
FIG. 13 is a graph of air flow versus speed control signal for the circuit of FIG. 12.

The operation of circuit 41 may be more easily understood with reference to the graph of of FIG. 13. In FIG. 13, the input signal S is represented by the horizontal axis, and the output signal $V_o$ is shown on the vertical axis. The straight line made up of solid line segment 190 and dotted line segment 191 represents the output voltage from clamp circuit 164, i.e. the voltage below which clamp circuit 164 prevents the output from falling. The cubic function made up of solid line segment 193 and dotted line segment 194 represents the output from circuit 150 for a given setting of potentiometer 170. Since the clamp circuit output is only a lower bound on the output voltage $V_o$, the actual transfer function of the circuit shown in FIG. 12 is shown by the solid curve 190 and 193. Adjusting the setting of potentiometer 170 varies the magnitude of the output signal from circuit 150. As the setting of potentiometer 170 is reduced, the transfer function of circuit 41 will vary in the manner shown by dotted line segments 196, thus effectively varying the point at which the transfer function changes from a linear relationship, representing the motor, drive, and friction losses, to a cubic function, representing the power required to exhaust the air in the fume hood.

A frequent problem encountered with fume hoods is the existence of back pressure, which is a high negative pressure inside the building. This is more common in large fume hood installations where there is an insufficient make-up air supply, but this situation can also result from HVAC operation. The magnitude of the back-pressure is usually variable. For example, a large fume hood installation with limited make-up air will normally have a higher back-pressure during busy periods when more fume hoods are open than at times when only a few hoods are being used.

The air flow provided by a fume hood blower running at a given speed is reduced by the backpressure. Consequently, the face velocity will be reduced. In extreme situations, the blower's static pressure can fall below the backpressure inside the building, and the fumes can reverse their flow and come out of the fume hood. This problem is greater at low blower speeds, since the blower's pressure decreases as the square of the speed.

Figure 14:
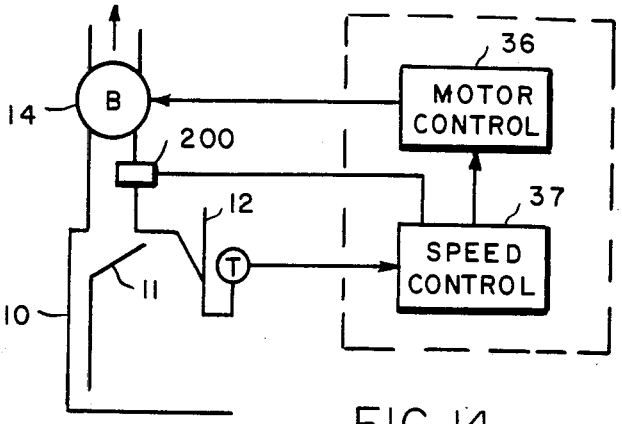
FIG. 14 shows an alternate embodiment of the present invention in which a flow sensor is to provide enhanced control of the air flow through each fume hood for low air flows.

FIG. 14 illustrates one configuration of the present invention which reduces or eliminates the above-described problems resulting from backpressure. In FIG. 14, a fume hood 10 is exhausted by a blower 14. Blower 14 is controlled by speed control circuit 37 which controls motor control circuit 36, similarly to FIG. 2. A flow sensor 200 is added to the system, and its output signal is applied to speed control circuit 37 as discussed below. The speed control circuit 37 is constructed as described below to ensure that flow sensor only has an appreciable effect at low blower speeds which reduces problems which may be caused by malfunctioning of the flow sensor.

Flow sensor 200 may be implemented in many ways. The key criteria is that the flow sensor provide an output signal which indicates when the face velocity is reduced by the existence of a high backpressure. A flow sensor may provide a direct measurement of the air flow and can be located either in the hood or in the ducting. In situations where there could be a large flow reversal, the sensor should be sensitive to flow dirction. In addition to the potential problem of sensor contamination discussed above, using a flow sensor in a closed loop system may result in oscillations. The air supply and exhaust systems have very long time constants, and oscillation can occur between the make-up air supply system and the fume hood exhaust system or even between two seperate fume hoods within the same room. The flow sensor and associated circuitry described herein avoids these problems by only using the flow sensor to augment the sash height signal in controlling the blower speed at low flow levels.

In the preferred embodiment, sensor 200 includes a hot-wire flow sensor which provides an output signal proportional to the air mass flowing past the sensor. To provide directional sensitivity, the hot wire may optionally have a thermally non-conductive material attached to the back of the flow sensor. The signal from the flow sensor is used only to increase the blower speed, and its effect is limited to low flow situations. Other types of flow sensors may be used in place of a hot-wire sensor, however.

Figure 15:
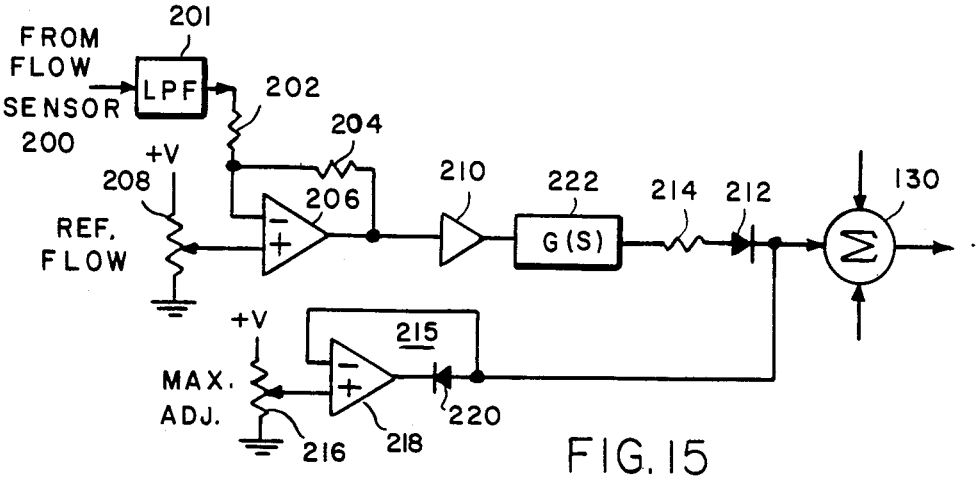
FIG. 15 shows one method for implementing the flow control circuit of FIG. 14.

Referring to FIG. 15, one circuit is shown for adding the signal from flow sensor 200 to the speed control circuit 37. The signal from flow sensor 200 is applied to the inverting input of an op-amp 206 via lo-pass filter 201 and resistor 202. Low pass filter 202 serves to filter and reduce variations in the signal from sensor 200 due to turbulence in the air flow. The output of op-mp 206 is connected to its inverting input via feedback resistor 204. The non-inverting input to op-amp 206 is connected to a voltage reference made up of potentiometer 208 connected between +V and ground. Potentiometer 208 is adjusted to select the air flow threshold below which the circuit will increase blower speed.

The output from op-amp 206 is applied to the input of a buffer amplifier 210. The output from amplifier 210 is applied via a filter 222, a resistor 214, and a diode 212 to an input to the summer circuit 130 of speed control circuit 37 shown in FIG. 10. Filter 222 is a low pass filter and also may provide further filtering to ensure stability. The output from filter 222 is applied via a diode 212 to an additional input of summer circuit 130 in FIG. 10. The remainder of the speed control circuit of FIG. 14 is as shown in FIG. 10.

Diode 212 serves two functions. At high flows, the signal from filter 222 will be negative, since the air flow will be much higher than the reference flow set by potentiometer 208. In this case, diode 212 becomes reverse biased and effectively disconnects the preceding circuitry from the system at high flows. Due to turbulence, the output from the circuitry ahead of filter 222 may be negative at times, and depending on the characteristics of the input signal and the parameters of filter 222, its output may also go negative. Diode 212 ensures that the input to summer 130 can only be positive so that the air flow can only be increased by the circuit of FIG. 15.

A clamp circuit 215 includes op-amp 218 and diode 220. The clamp circuit limits the output from amplifier 210 so that it does not exceed a selected value. This clamp value is selected by potentiometer 216 which provides a variable voltage to the non-inverting input of op-amp 218.

The circuit of FIG. 15 operates in the following manner. The output signal from the flow sensor is a positive signal proportional to the air flow. The signal applied to summer 130 will be zero unless the signal from the flow sensor drops below the reference flow level set by potentiometer 208. At this point a positive signal is applied by op-amp 206 to the input of amplifier 210. This signal is applied via buffer amplifier 210 to filter 222. This filter has a very long time constant, typically on the order of tens of seconds, and serves to prevent oscillations due to interactions between the various components of the building's air supply and exhaust. The increase in the fan speed is limited to a maximum value determined by potentiometer 216. The main blower control is thus provided by the sash transducer for rapid response to sash movements whereas the flow transducer provides fine tuning for improved long-term accuracy at low flows to ensure that the face velocity remains high enough to exhaust fumes from the hood.

Alternatively, a low pressure sensor may be used to sense the pressure differential between the duct and the room, since high back-pressure will reduce this differential. Pressure is proportional to the square of the air flow, assuming that the drop across the ducting is much greater than the drop across the sash opening, as is the case in most fume hood systems. Thus, implementing sensor 200 as a pressure sensor and comparing its output to a fixed reference with a circuit such as that shown in FIG. 15 is equivalent to using an air flow sensor. Pressure sensors are less prone to being blocked or jamed than are flow sensors and inherently have direction sensitivity.

Additionally, the pressure differential between the fume hood room and the area into which the blower exhausts may be measured, and this measurement can be used to increase the volume of make-up air supplied by the make-up air system.

Figure 16:
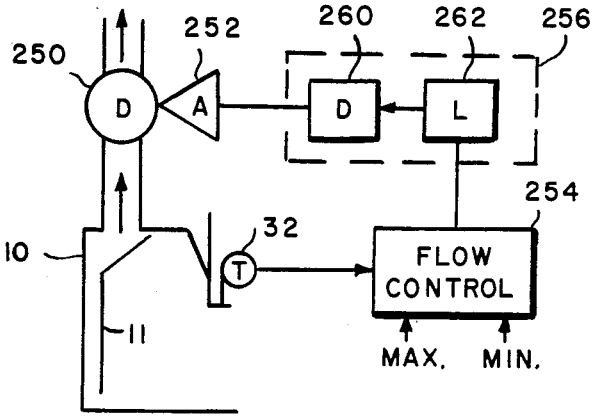
FIG. 16 shown an alternate embodiment of the present invention in which a damper is used to control the air flow through a fume hood.

The previously-described embodiments of the present invention are most useful in single exhaust fume hood systems where there is a seperate blower and motor for each hood, or in small ganged-hood systems where one blower and motor may be connected to two or three hoods. For larger ganged-hood systems where many hoods are manifolded into a large exhaust fan, an alternate embodiment of the invention as shown in FIG. 16 may be advantageously used. In the embodiment shown in FIG. 16, the air flow through the hood is varied as the sash is raised and lowered by means of a damper, rather than by controlling blower speed. Because dampers are less expensive than variable frequency drives, cost considerations may make the embodiment of FIG. 16 preferrable in many situtations, including single exhaust systems.

The system shown in FIG. 16 is preferably used with a pressure-independent type of damper or flow control valve. Pressure-independent dampers or damper systems are available in several different types. They operate by providing, for a particular damper setting or air flow command, an air flow which is relatively independent of pressure changes across the damper. The use of a pressure-independent damper is very important when used in ganged-hood systems, as discussed below. However, pressure-independent dampers are also helpful in single hood systems to reduce variations in the hood face velocity due to nonlinearities in the blower pressure versus flow curve and changes in the ambient pressure of the hood environment caused by inadequate make-up air or HVAC operation, for example.

In FIG. 16, a fume hood 10 has its exhaust hood connected to the exhaust ductwork via a damper 250. Damper 250 is controlled by an actuator 252 and provides a variable resistance to air flow in response to a signal applied to the actuator. The output from sash transducer 32 is applied to a flow control circuit 254. Flow control circuit 254 may be implemented by the circuit circuit shown in FIG. 10 above.

The output signal from flow controller 254 goes to an interface circuit 256. Interface circuit 256 performs two functions. Depending on the type of damper used, the relation between the magnitude of the input signal to the damper actuator and the air flow may not be linear. If this is the case, a linearizing circuit 262 may be used to provide a linear relation between the flow control output signal and the air flow through damper 250. The details of such a circuit will depend upon the characteristics of the particular damper being used. Many suitable circuits are known to those of ordinary skill in the art.

On example of such a circuit is that shown and described above with reference to FIG. 12.

A drIver circuit 260 provides the power to move the damper actuator in response to an input signal. Dampers are typically actuated by pneumatic or electrical actuators. If a pneumatic actuator is being used, driver circuit 260 will include a voltage-to-pressure converter. If the actuator is electrically acutated, the actuator driver circuit 260 provides an output signal which varies over the appropriate range and has sufficient power to drive the actuator.

Figure 17:
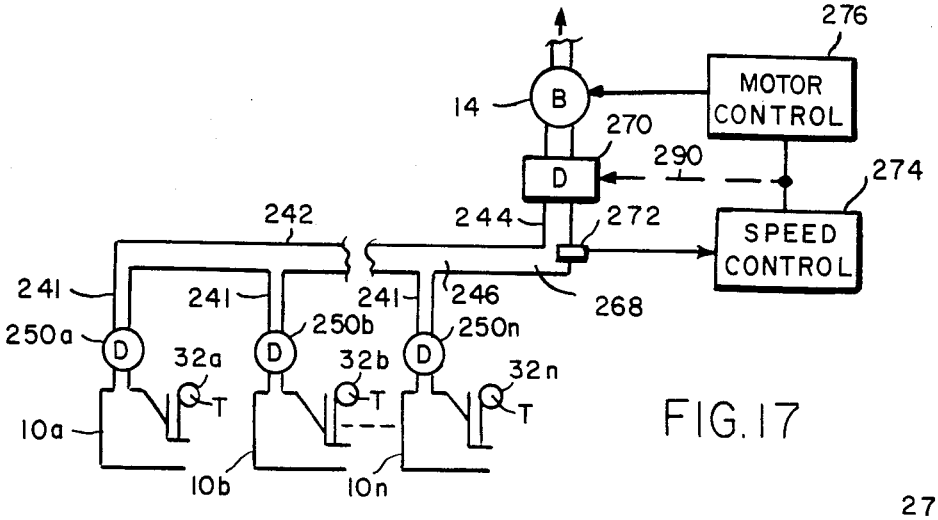
FIG. 17 shows a multiple fume hood installation using the alternate embodiment of the invention shown in FIG. 16.

A common situation in implementing the present invention with existing fume hood systems is that the pressure drop through the ducting is frequently much greater than the pressure drop across the hood sashes. This prevents a ganged hood system in which the blower speed is controlled, such as the system shown in FIG. 5, from being fully effective in maintaining a constant face velocity To illustrate this, FIG. 17 shows an exemplary system in which several hoods are connected to a common manifold duct 242 which, in turn, is connected via a long exhuast duct 244 to an exhaust blower which is typically located on a roof or other isolated location. Due to the baffle 11 used in directing the flow inside the fume hood and the length of the ducting seperating the hoods from each other, the pressure drop through the fume hood and along the exhaust ducts 241 and 242 may be much larger than the drop across the sash opening, even for small sash openings. For example, the pressure drop along the ducting might be equal to about 1.0 inches of water while the drop across the sash openings would typically be on the order of 0.02 inches of water.

The effect of this may be seen by assuming that the two hoods 10*a* and 10*b* in FIG. 17 are operating with their sashes fully open so that the flow through each is 100% oi the maximum flow. If one of the hoods has its sash closed almost all the way so that the sash opening and desired flow decreases to 20% of the maximum flow, the blower speed control circuitry will reduce the blower speed and air flow to 60% of its former value. However, the system resistance from each hood to point 246 where the fume hoods are connected to the main duct will be essentially unchanged for almost all sash positions of each hood due to the small pressure drop across the hood opening. The result is that the flow through both hoods is reduced by roughly equal amounts to 60% of the original flow, rather than reducing only the flow in the hood whose sash is lowered.

With the damper-controlled system of FIG. 16, most of the pressure drop between the fan and the hood occurs across the damper. Thus, the effects of pressure drops across the fume hood baffle 11 and along the exhaust ducting may be reduced or eliminated by using a damper controlled fume hood. Referring to FIG. 17, such a system is shown including a plurality of fume hoods 10*a* through 10*n*. Each fume hood has an associated damper 250*a* through 250*n* each of which is controlled by a flow control circuit, not shown, similar to to that of FIG. 16 in response to the signal irom the associated sash transducers 32*a* through 32*n*. The dampers 250 are connected to a manifold duct 242 which, in turn, is connected to an exhaust duct. A blower 14 pulls air through the fume hoods via ducts 242 and 244. Typically, the total airflow provided by blower 14 is adjustable either by adjusting the blower speed or by a fixed damper 270.

As fume hood sashes are moved, the air flow, and hence the pressure drop, through the exhaust ducting 244 will vary over a wide range. Thus, the air pressure in the manifold 242 connecting the hoods will change as the air flow varies with the raising and lowering of sashes. It is desirable to use pressure-independent flow valves for the dampers to keep the face velocity relatively independent of the pressure in the manifold.

If the total air flow can be varied, such as by a damper 270 in the exhaust duct or by changing the speed of the blower motor, the total air flow adjustment is made by fully opening the sashes of all of the fume hoods and varying the air flow until the face velocity of the hood having the lowest face velocity (usually the hood farthest removed from the blower 14) is at an acceptable level. This level is usually somewhat higher than the desired face velocity to allow for drops in air flow caused by unforseen circumstances, such as partially blocked ducts, slipping drive belts, building backpressure, etc.

With a system having a fixed blower speed, such as that described above, there is some loss of efficiency due to the fact that the blower speed must be sufficient to provide adequate air flow for the worst case condition, namely when the sashes of all the fume hoods are fully open. Thus, most of the time the blower motor will be working harder than necessary. It should be noted that losses due to exhausting excess make-up air that has been heated or cooled are greatly reduced by the system shown in FIG. 17, even without the constant pressure feature described below.

This situation can be remedied by installing a pressure sensor at an appropriate location in the ducting and varying the blower speed to keep the pressure at that point constant. Referring to FIG. 17, a pressure sensor 272 is preferably located in the exhaust ducting just upstream of the connection to fume hood 10*n* closest to the blower, although surge characteristics of the blower may require moving this sensor down the ductwork to a location further from the fan. The pressure sensor senses the pressure in the duct at this point and provides an electrical signal representative thereof. The output from pressure sensor 272 is applied to speed control circuit 274, described below.

The output signal from the speed control circuit is applied to a motor controller which drives the blower motor at the commanded speed to control air flow and pressure in the duct. The motor controller described in the above-referenced U.S. Pat. No. 4,400,655 may be used, although other types of motor controllers are also suitable. Optionally, the output from the speed control circuit may be used to drive a damper to control the duct pressure, as indicated by dashed line 290.

Figure 19:
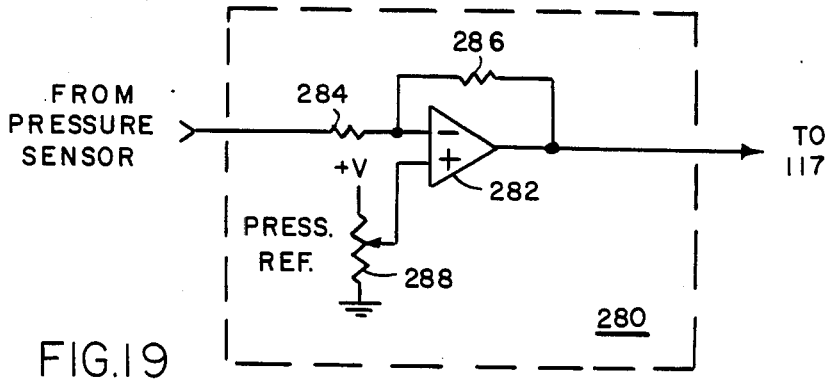
FIG. 19 shows circuitry used in the speed control circuit of FIG. 17.

Speed control circuit 274 is similar to the speed control circuit shown in FIG. 10, except that the input amplifier stage 104 is replaced with the circuit shown in FIG. 19. The pressure sensor provides an output voltage that is proportional to the sensed pressure, and this signal is applied to the input of an amplifier/comparator circuit 280 of FIG. 19 which replaces the input amplifier stage 104 in FIG. 10. Circuit 280 includes an inverting amplifier stage made up of op-amp 282, input resistor 284 connected to the inverting input of op-amp 282, and feedback resistor 286. The gain of this amplifier stage is determined by the values of resistors 284 and 286, and the value for the gain is selected depending upon the specifications and output signal range of sensor 272. The non-inverting input to the op-amp is connected to the wiper of a potentiometer 288 which is connected between +V and ground. The output of circuit 280 is taken from the output of op-amp 282.

The blower motor control circuit of FIG. 17 including pressure sensor 272, speed control 274, motor control 276, and blower 14 form a closed loop which tends to keep the pressure at point 268 in the duct constant. The signal from the pressure sensor is compared with a reference voltage from potentiometer 288 representative of a reference pressure. If the pressure goes above or below the desired pressure, the output of amplifier 280 changes in a direction which tends to adjust the pressure back to the desired pressure. The velocity adjustment in FIG. 10 controls the closed loop gain and determines the speed of response of the system. In some situations, additional filtering may be necessary to maintain stability. The minimum flow adjustment of FIG. 10 may be omitted or may be used to provide a minimum flow level as a safety back-up in case of failure of the pressure sensor.

Maintaining a constant pressure at point 268 in the duct also serves to help keep a more constant face velocity for each hood. In situations where pressure drops in the manifold duct 242 are small, the constant pressure feature described above reduces or eliminates the need for pressure-independent types of dampers. This is advantageous in situations where this type of damper is already installed in a pre-existing fume hood installation. Another advantage of using the embodiment of FIG. 16 is that the large pressure drop across the damper will greatly reduce the effects of backpressure in the fume hood room. By using a pressure sensor of the type that measures gauge pressure, which is the difference between the ambient room pressure and the pressure in the duct, the effects of backpressure in the fume hood room can be even further reduced or completely eliminated.

Figure 18:
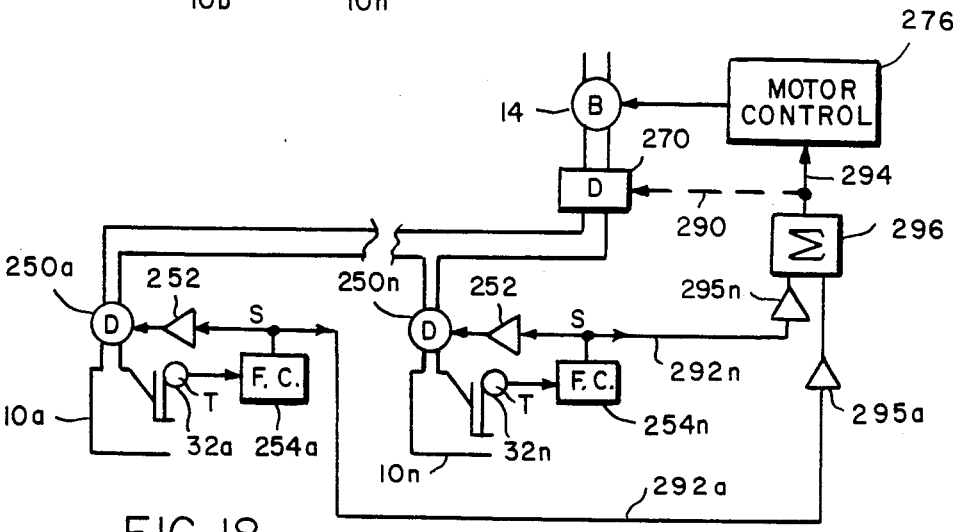
FIG. 18 shows an alternate embodiment of the system of FIG. 17.

FIG. 18 shows an alternate embodiment of the system of FIG. 17 in which the central blower 14 is controlled by a signal generated by combining the flow control signals from each of the flow control circuits 254 for each of the hoods. In FIG. 18, a plurality of hoods 10*a*–10*n* each have an associated damper 250 which is controlled by flow control circuitry 254 as described above. The output signals 292 from each of the flow control circuits 254 are applied to summing circuitry 296. Scaling circuits 295 may be used in each of the lines from the flow controller circuits 254 to proportionally scale the individual flow control signals to take into account hoods having different sash opening areas, different desired face velocities (for chemicals of different toxicity, for example), and other factors which may make the desired flow different in different hoods. The output signal on line 294 from summing circuit 296 is then used to control the total flow through the fume hood system. This may be done by applying the signal on line 294 to a motor speed control circuit 276 to control the speed of blower 14, or the output of the summer may be used to control a damper 276, as indicated by dotted line 290.

There has been described a new and useful system for controlling a fume hood to achieve a substantially constant face velocity. Modifications to the embodiments described herein may be made by those of ordinary skill in the art in applying the teachings of the present invention to different situations and applications. Accordingly, the description herein of a preferred embodiment for the purpose of illustrating the invention should not be taken as a limitation on the invention. Rather, the invention should be interpreted in accordance with the following claims.

What is claimed is:

1. A fumed hood controller for controlling the air flow through a fume hood to maintain a relatively constant face velocity through a fume hood opening as the fume hood sash is moved, comprising:

transducer means responsive to the position of the fume hood sash for producing a sash opening signal the value of which is a substantially continuous and monotonic function of the sash opening;

air flow control means, responsive to an air flow signal, for varying the air flow through the fume hood in accordance with the air flow signal;

flow control means, responsive to the sash opening signal, for producing the air flow signal, including:

means for setting a first air flow at a first sash position;

means for setting a second air flow at a second sash position; and means for providing, to the air flow means, an air flow control signal having a value so as to maintain the air flow through the hood substantially proportional to the sash opening area as the sash is moved between the first and second sash positions, said means for providing including means for maintaining a linear relationship between the air flow signal and the air flow through the hood.

2. The fume hood controller of claim 1 wherein the transducer means includes a variable resistor connected to the sash so that the resistance varies as the sash is moved.

3. The controller of claim 2 wherein the transducer means comprises:

a cable having one end connected to the fume hood sash; and a constant-tension, spring-return, cable-driven potentiomenter, including a reel to which is attached the cable so that the potentiometer is varied by the cable unwinding and winding on the reel as the sash moves.

4. The controller of claim 1 wherein the air flow control means includes a damper.

5. The controller of claim 1 wherein the air flow control means includes:

means, responsive to the air flow signal, for providing a variable resistance to air flow as a function of the air flow signal; and means, responsive to the air flow signal, for maintaining a constant air flow through the air flow means for a constant air flow signal, independent of pressure changes across the means for providing a variable resistance.

6. The fume hood controller of claim 1 wherein the flow control means further includes:

turndown means for selecting a sash position as said first sash position wherein the sash is less than fully closed;

means for setting a minimum air flow at the first sash position; and means for setting a maximum air flow at a second sash position;

said means for producing the air flow signal further including:

means for changing the air flow signal as a substantially linear function of the sash opening signal as the sash moves between the first position and the second position; and means for maintaining the air flow signal at said minimum air flow when the sash is below the position first.

7. The controller of claim 1 wherein the air flow signal providing means includes means for sensing the air flow volume through the hood.

8. The controller of claim 1, wherein the air flow control means further includes.

an exhaust blower driven by a blower motor and connected to the fume hood via exhaust ducting; and means responsive to the air flow signal, for varying the speed of the blower motor;

wherein the controller further includes sensor means, located in the air flow between the fume hood and the exhaust blower, for providing a second signal representative of the air flow through the hood; and wherein the flow control means further includes means responsive to the second signal for increasing the blower motor speed when the second signal drops below a predetermined minimum level.

9. The controller of claim 8 wherein the sensor means includes a sensor located in the exhaust ducting for measuring the pressure differential between interior of the ducting and the exterior of the fume hood and for providing a signal representative thereof.

10. The controller of claim 9 wherein the means for increasing the blower motor speed includes:

means for setting a reference signal representative of a minimum air flow;

means for comparing the reference signal with the second signal and for providing a difference signal representative of the difference therebetween; and means for increasing the motor speed when the difference signal indicates that the air flow is less than the minimum air flow level.

11. The controller of claim 2 wherein the air flow control means includes a damper.

12. The controller of claim 3 wherein the air flow control means includes a damper.

13. In a fume hood installation having a plurality of fume hoods each including a sash which moves to provide an opening for access to the fume hood interior; and exhaust blower driven by a blower motor; and exhaust ducting connecting each of the fume hoods to the blower; a fume hood controller, comprising;

a plurality of transducer means, equal in number to the number of fume hoods and each transducer being associated with a respective one of the fume hoods, each for producing a respective sash opening signal the value of which is a substantially continuous and monotonic function of the associated sash opening;

a plurality of flow control means, each associated with a respective one of the transducer means and responsive to the sash opening signal therefrom, for producing an air flow signal representative of a desired air flow through the associated hood, the air flow signal being a function of the sash opening signal; and a plurality of air flow control means, each associated with a respective one of the fume hoods and responsive to the air flow signal, for controlling the air flow through the associated fume hood so that it varies in accordance with the air flow signal;

each flow control means further including:

means for setting a first air flow at the first sash position;

means for setting a second air flow at the second sash position; and means for providing, to the air flow control means, an air flow signal having a value so as to maintain the air flow through the hood substantially proportional to the sash opening area as the sash is moved between the first and second sash positions, said means for providing including means for maintaining a linear relationship between the air flow signal and the air flow through the hood.

14. The controller of claim 13 wherein each of the air flow control means includes means, located in the ducting between the associated hood and the blower for providing a variable resistance to the air flow through the hood.

15. The controller of claim 13 wherein the means for providing a variable resistance includes a damper.

16. The controller of claim 14 wherein the means for providing a variable resistance includes:

means, responsive to the air flow signal, for providing a variable resistance to air flow as a function of the air flow signal; and means, responsive to the air flow signal, for maintaining a constant air flow control through the air flow means for a constant air flow signal, independent of pressure changes across the means for providing a resistance.

17. The controller of claim 14 further including:

means, responsive to the sash opening signals from each of the transducer means, for providing a combined sash signal; and means responsive to the combined sash signal for controlling the total air flow provided by the exhaust blower.

18. The controller of claim 17 wherein the means for providing a combined sash signal includes means, responsive to the sash opening signals from each transducer, for providing a combined sash signal which is proportional to the sum of the sash opening signals.

19. The controller of claim 18 wherein the means for combining further includes means for scaling each of the sash opening signals by a scale factor reflecting the proportionality of the air flow through the associated hood to the total air flow through the exhaust blower.

20. The controller of claim 19 wherein the means for controlling the total air flow includes means for controlling the speed of the blower motor as a function of the combined sash signal.

21. The controller of claim 19 wherein the means for controlling the total air flow includes means for providing a variable resistance to the total air flow through the exhaust blower.

22. The controller of claim 21 wherein the means for providing a variable resistance to the air flow through the blower includes a damper in series with the exhaust blower.

23. The controller of claim 14 further including:

a pressure sensor, located in the air flow between the blower and the fume hoods and upstream of the fume hood whose connection to the ducting is closest to the blower, for measuring pressure and providing a pressure signal representative thereof;

means for providing a reference signal representative of a reference pressure level; and means, responsive to the reference signal and to the pressure signal, for controlling the air flow provided by the exhaust blower so as to maintain a relatively constant pressure at the the pressure sensor.

24. The controller of claim 23 wherein the means for controlling the exhaust blower air flow includes means for varying the speed of the blower motor.

25. The controller of claim 23 wherein the means for controlling the exhaust blower air flow includes a damper in series with the total airflow through the exhaust blower.

26. The controller of claim 13 wherein each of the transducer means comprises:

a cable having one end connected to the associated fume hood sash; and a constant-tension, spring-return, cable-driven potentiometer, including a reel to which is attached the cable so that the potentiometer is varied by the cable unwinding and winding on the reel as the associated sash moves.

* * * * *

UNITED STATES PATENT AND TRADEMARK OFFICE

CERTIFICATE OF CORRECTION

PATENT NO. : 4,706,553

DATED : November 17, 1987

INVENTOR(S) : Gordon P. Sharp, et al.

It is certified that error appears in the above-identified patent and that said Letters Patent is hereby corrected as shown below:

Claim 1, col. 20, line 22, after "air flow" insert --control--.

Claim 1, col. 20, line 23 after "flow" delete "control".

Claim 5, col. 20, line 51, change "air flow means" to --air flow control means--.

Claim 6, col. 21, line 5, change "position first" to --first position--.

Claim 13, col. 21, line 46, change "and exhaust" to --an exhaust--.

Claim 13, col. 22, line 1, change "the first sash" to --a first sash--.

Claim 13, col. 22, line 3, change "at the second" to --at a second--.

UNITED STATES PATENT AND TRADEMARK OFFICE

CERTIFICATE OF CORRECTION

PATENT NO. : 4,706,553

DATED : November 17, 1987

INVENTOR(S) : Gordon P. Sharp, et al.

It is certified that error appears in the above-identified patent and that said Letters Patent is hereby corrected as shown below:

Claim 16, col. 22, line 26-27 change "air flow control through the air flow means" to --air flow through the air flow control means--.

Signed and Sealed this

Eighth Day of August, 1989

*Attest:*

DONALD J. QUIGG

*Attesting Officer*

*Commissioner of Patents and Trademarks*

REEXAMINATION CERTIFICATE (1516th)

United States Patent [19] [11] B1 4,706,553

Sharp et al. [45] Certificate Issued Jul. 23, 1991

[54] FUME HOOD CONTROLLER

[75] Inventors: Gordon P. Sharp, Newton; William P. Curtiss, Winthrop; George B. Yundt, Cambridge, all of Mass.

[73] Assignee: Phoenix Controls Corporation

Reexamination Request:
No. 90/002,039, Jun. 4, 1990

Reexamination Certificate for:

| | |
|---|---|
| Patent No.: | **4,706,553** |
| Issued: | **Nov. 17, 1987** |
| Appl. No.: | **732,205** |
| Filed: | **May 8, 1985** |

Related U.S. Application Data

[63] Continuation of Ser. No. 586,007, Mar. 5, 1984, Pat. No. 4,528,898.

[51] Int. Cl.[5] ..... B05B 15/02
[52] U.S. Cl. ..... 98/115.3
[58] Field of Search ..... 98/1.5, 115.1, 115.3; 236/49

[56] References Cited

U.S. PATENT DOCUMENTS 4,215,627 8/1980 Garris ..... 98/115.3

FOREIGN PATENT DOCUMENTS 8004561-0 6/1980 Sweden .
1325763 8/1973 United Kingdom .
2076145 11/1981 United Kingdom .

OTHER PUBLICATIONS

"Mock-up in Testing of a Variable Volume Laboratory Fume Hood Exhaust System" a report from the Argonne National Laboratory which was completed in 1978 and filmed and made available to the general public via the National Technical Information Service (NTIS) U.S. Department of Commerce, Springfield, VA 22161, Publication ANL/ENG 78-03, Apr. 24, 1980.

Position/Displacement Transducer, a brochure by Celesco Transducer Products, Inc., effective Feb. 15, 1981.

Variable Air Volume Systems & Hardware, a brochure by Mitco Corporation, dated Aug. 1972.

Airflow Control and the Pressurization of Bacterial and Viral Research Laboratories, Pharmaceutical Production Areas, Nuclear Facilities, Contaminated Spaces, Clean Rooms, a brochure by Air Monitor Corporation, 1977, pp. 1-20.

The Principles of Airflow Control, a brochure by Air Monitor Corporation, 1978, pp. 1-12.

Fire Protection for Laboratories Using Chemicals by National Fire Protection Association, 1975.

*Primary Examiner*—Harold Joyce

[57] ABSTRACT

A fume hood controller system in which the sash position is monitored by a transducer which provides a signal indicative of the area of the hood opening. A variable speed motor controller is responsive to the sash position signal to provide a fan speed which varies in a substantially continuous and linear manner as a function of the sash opening. In an alternate embodiment, the air flow through the hood is controlled by a damper or similar device. Several embodiments are shown in which the present invention may be used to control a fume hood system in which a blower exhausts a plurality of fume hoods while maintaining a substantially constant face velocity in each hood.

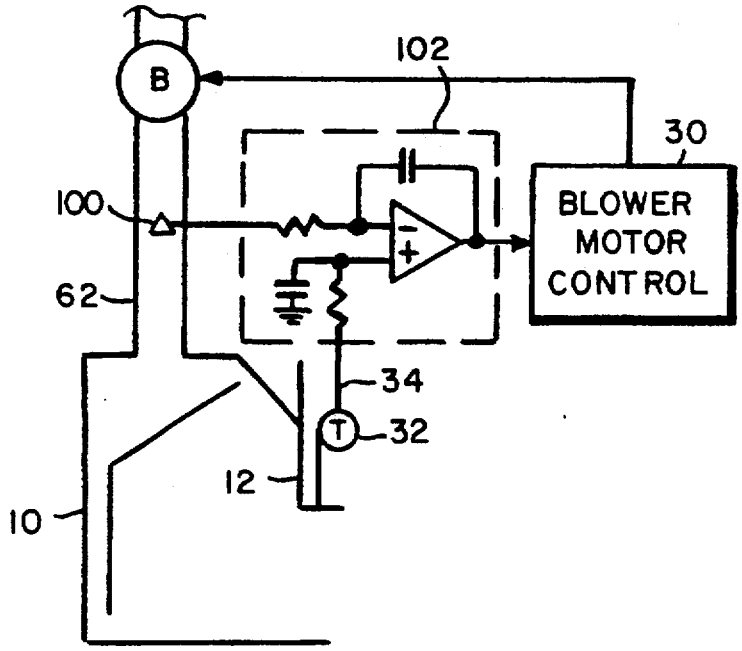

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 8–10 and 19–25 is confirmed.

Claims 1–7, 11–18 and 26 are cancelled.

8. The controller of claim 1, wherein the air flow control means further includes:

an exhaust blower driven by a blower motor and connected to the fume hood via exhaust ducting; and means responsive to the air flow signal, for varying the speed of the blower motor;

wherein the controller further includes sensor means, located in the air flow between the fume hood and the exhaust blower, for providing a second signal representative of the air flow through the hood; and wherein the flow control means further includes means responsive to the second signal for increasing the blower motor speed when the second signal drops below a predetermined minimum level.

* * * * *

US004706553B1

REEXAMINATION CERTIFICATE (2059th)

United States Patent [19]

Sharp et al.

[11] B1 4,706,553

[45] Certificate Issued Jul. 13, 1993

[54] FUME HOOD CONTROLLER

[75] Inventors: Gordon P. Sharp, Newton; William P. Curtiss, Winthrop; George B. Yundt, Cambridge, all of Mass.

[73] Assignee: Phoenix Controls Corp., Boston, Mass.

Reexamination Request:
No. 90/002,039, Jun. 4, 1990

Reexamination Certificate for:

| | |
|---|---|
| Patent No.: | 4,706,553 |
| Issued: | Nov. 17, 1987 |
| Appl. No.: | 732,205 |
| Filed: | May 8, 1985 |

Certificate of Correction issued Aug. 8, 1989.

Related U.S. Application Data

[63] Continuation-in-part of Ser. No. 586,007, Mar. 5, 1984, Pat. No. 4,528,898.

[51] Int. Cl.[5] ..... B08B 15/02

[52] U.S. Cl. ..... 454/61

[58] Field of Search ..... 98/1.5, 115.1, 115.3; 236/49

[56] References Cited

U.S. PATENT DOCUMENTS 4,215,627 8/1980 Garris ..... 98/115.3

FOREIGN PATENT DOCUMENTS 8004561 6/1980 Sweden .
1325763 8/1973 United Kingdom .
2076145 11/1981 United Kingdom .

OTHER PUBLICATIONS

Fire Protection for Laboratories Using Chemicals by National Fire Protection Association, 1975.

"Mock-up in Testing of a Variable Volume Laboratory Fume Hood Exhaust System" a report from the Argonne National Laboratory which was completed in 1978 and filmed and made available to the general public via the National Technical Information Service (NTIS) U.S. Department of Commerce, Springfield, Va. 22161, Publication ANL/ENG 78-03, Apr. 24, 1980.

Position/Displacement Transducer, a brochure by Celesco Transducer Products, Inc., effective Feb. 15, 1981.

Variable Air Volume Systems & Hardware, a brochure by Mitco Corporation, dated Aug. 1972.

Airflow Control and the Pressurization of Bacterial and Viral Research Laboratories, Pharmaceutical Production Areas, Nuclear Facilities, Contaminated Spaces, Clean Rooms, a brochure by Air Monitor Corporation, 1977, pp. 1-20.

The Principles of Airflow Control, a brochure by Air Monitor Corporation, 1978, pp. 1-12.

*Primary Examiner*—Harold Joyce

[57] ABSTRACT

A fume hood controller system in which the sash position is monitored by a transducer which provides a signal indicative of the area of the hood opening. A variable speed motor controller is responsive to the sash position signal to provide a fan speed which varies in a substantially continuous and linear manner as a function of the sash opening. In an alternate embodiment, the air flow through the hood is controlled by a damper or similar device. Several embodiments are shown in which the present invention may be used to control a fume hood system in which a blower exhausts a plurality of fume hoods while maintaining a substantially constant face velocity in each hood.

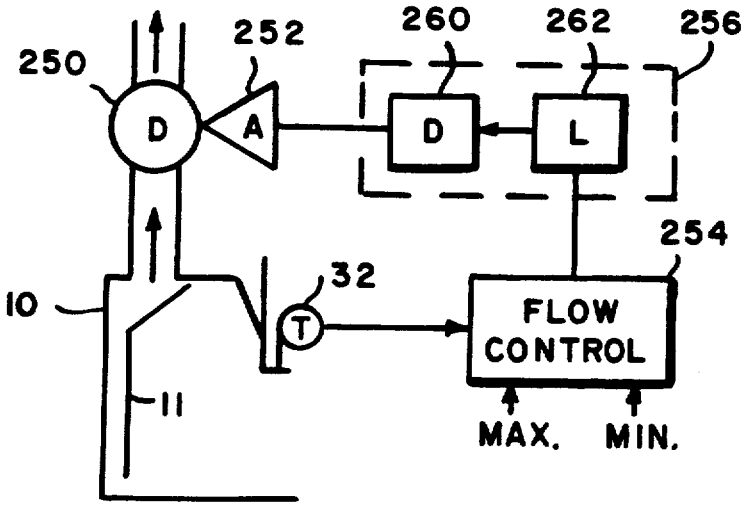

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates addition made to the patent.

AS A RESULT OF REEXAMINATION, IT HAS BEEN DETERMINED THAT:

Claims 6, 17–19 and 23 are cancelled.

Claims 1, 2, 4, 5, 7–10, 13–16, 20, 21, 24 and 25 are determined to be patentable as amended.

Claims 3, 11, 12, 22 and 26 dependent on an amended claim, are determined to be patentable.

New claims 27–31 are added and determined to be patentable.

1. A fume hood controller for controlling the air flow through a fume hood to maintain a relatively constant face velocity through a fume hood opening as the fume hood sash is moved, comprising;

transducer means responsive to the position of the fume hood sash for producing a sash opening signal the value of which is a substantially continuous and monotonic function of the sash opening;

air flow control means, responsive to an air flow signal, for varying the air flow through the fume hood in accordance with the air flow signal;

flow control means, responsive to the sash opening signal for producing the air flow signal, including: *turndown means for selecting a sash position as a first sash position wherein the sash is less than fully closed;* means for setting a [first] *minimum* air flow at [a] *the* first sash position;

means for setting a [second] *maximum* air flow at a second sash position; [and]

means for providing, to the air flow *control* means, an air flow [control] signal having a value so as to maintain the air flow through the hood substantially proportional to the sash opening area as the sash is moved between the first and second sash positions, said means for providing including means for maintaining a linear relationship between the air flow signal and the air flow through the hood[.]*;*

*means for changing the air flow signal as a substantially linear function of the sash opening signal as the sash moves between the first position and the second position; and*

*means for maintaining the air flow signal at said minimum air flow when the sash is below the first position.*

2. The fume hood controller of claim [1] *28* wherein the transducer means includes a variable resistor connected to the sash so that the resistance varies as the sash is moved.

4. The controller of claim [1] *28* wherein the air flow control means includes a damper.

5. The controller of claim [1] *28* wherein the air flow control means includes:

means, responsive to the *first* air flow signal, for providing a variable resistance to air flow as a function of the *first* air flow signal; and means, responsive to the air flow signal, for maintaining a constant air flow through the air flow means for a constant air flow signal, independent of pressure changes across the means for providing a variable resistance.

7. The controller of claim [1] *28* wherein the *first* air flow signal providing means includes means for sensing the air flow volume through the hood.

8. [The controller of claim 1, wherein the air flow control means further includes:] *A fume hood controller for controlling the air flow through a fume hood to maintain a relatively constant face velocity through a fume hood opening as the fume hood sash is moved comprising:*

*transducer means responsive to the position of the fume hood sash for producing a sash opening signal the value of which is a substantially continuous and monotonic function of the sash opening;* an exhaust blower driven by a blower motor and connected to the fume hood via exhaust ducting; [and]

means response to an air flow signal [,] for varying the speed of the blower motor *to control the air flow through the fume hood in accordance with the air flow signal;* [wherein the controller further includes]

sensor means, located in the air flow between the fume hood and the exhaust blower, for providing a second signal representative of the air flow through the hood; [and]

*flow control means, responsive to the sash opening signal, for producing the air flow signal, including:* [wherein the flow control means further includes]

means responsive to the second signal for increasing the blower motor speed when the second signal drops below a predetermined minimum level*;*

*means for setting a first air flow at a first sash position,* means for setting a second air flow at a second sash position; and

*means for providing, to the air flow control means, an air flow control signal having a value so as to maintain the air flow through the hood substantially proportional to the sash opening area as the sash is moved between the first and second sash positions, said means for providing including means for maintaining a linear relationship between the air flow signal and the air flow through the hood.*

9. The controller of claim [8] *29* wherein the sensor means includes a sensor located in the exhaust ducting for measuring the pressure differential between interior of the ducting and the exterior of the fume hood and for providing a signal representative thereof.

10. The controller of claim 9 wherein the means for increasing the blower motor speed includes:

means for setting a reference signal represenative of a minimum air flow;

means for comparing the reference signal with the [second] *control* signal and for providing a difference signal representative of the difference therebetween; and means for increasing the motor speed when the difference signal indicates that the air flow is less than the minimum air flow level.

13. In a fume hood installation having a plurality of fume hoods each including a sash which moves to provide an opening for access to the fume hood interior; [and] *an* exhaust blower driven by a blower motor; and exhaust ducting connecting each of the fume hoods to the blower; a fume hood controller, comprising:

a plurality of transducer means, equal in number to the number of fume hoods and each transducer being associated with a respective one of the fume hoods, each for producing a respective sash opening signal the value of which is a substantially continuous and monotonic function of the associated sash opening;

a plurality of flow control means, each associated with a respective one of the transducer means and responsive to the sash opening signal therefrom, for producing an air flow signal representative of a desired air flow through the associated hood, the air flow signal being a function of the sash opening signal; [and]

a plurality of air flow control means, each associated with a respective one of the fume hoods and responsive to the air flow signal, for controlling the air flow through the associated fume hood so that it varies in accordance with the air flow signal;

each flow control means further including:

means for setting a first air flow at the first sash position[;], means for setting a second air flow at the second sash position[;], and means for providing, to the air flow control means, an air flow signal having a value so as to maintain the air flow through the hood substantially proportional to the sash opening area as the sash is moved between the first and second sash positions, said means for providing including means for maintaining a linear relationship between the air flow signal and the air flow through the hood[.];

*means for scaling each of the sash opening signals by a scale factor reflecting the propotionality of the air flow through the associated hood to the total air flow through the exhaust blower;*

*means, responsive to the sash opening signals from each transducer, for providing a combined sash signal which is proportional to the sum of the sash opening signals; and*

*means responsive to the combined sash signal for controlling the total air flow provided by the exhaust blower.*

14. The controller of claim [13] *30* wherein each of the air flow control means includes means, located in the ducting between the associated hood and the blower for providing a variable resistance to the air flow through the hood.

15. The controller of claim [13] *14* wherein the means for providing a variable resistance includes a damper.

16. The controller of claim 14 wherein the means for providing a variable resistance includes:

means, responsive to the *second* air flow signal, for providing a variable resistance to air flow as a function of the *second* air flow signal; and means, responsive to the *second* air flow signal, for maintaining a constant *second* air flow [control] through the air flow *control* means for a constant air flow signal, independent of pressure changes across the means for providing a resistance.

20. The controller of claim [19] *13* wherein the means for controlling the total air flow includes means for controlling the speed of the blower motor as a function of the combined sash signal.

21. The controller of claim [19] *13* wherein the means for controlling the total air flow includes means for provising a variable resistance to the total air flow through the exhaust blower.

24. The controller of claim [23] *31* wherein the means for controlling the exhaust blower air flow includes means for varying the speed of the blower motor.

25. The controller of claim [23] *27* wherein the means for controlling the exhaust blower air flow includes a damper in series with the total airflow through the exhaust blower.

*27. In a fume hood installation having a plurality of fume hoods each including a sash which moves to provide an opening for access to the fume hood interior; an exhaust blower driven by a blower motor; and exhaust ducting connecting each of the fume hoods to the blower; a fume hood controller, comprising:*

*a plurality of transducer means, equal in number to the number of fume hoods and each transducer being associated with a respective one of the fume hoods, each for producing a respective sash opening signal the value of which is a substantially continuous and monotonic function of the associated sash opening;*

*a plurality of flow control means, each associated with a respective one of the transducer means and responsive to the sash opening signal therefrom, for producing an air flow signal representative of a desired air flow through the associated hood, the air flow signal being a function of the sash opening signal;*

*a plurality of air flow control means, each associated with a respective one of the fume hoods and responsive to the air flow signal, for controlling the air flow through the associated fume hood so that it varies in accordance with the air flow signal, each flow control means further including:*

*means for setting a first air flow at the first sash position, means for setting a second air flow at the second sash position, and means for providing, to the air flow control means, an air flow signal having a value so as to maintain the air flow through the hood substantially proportional to the sash opening area as the sash is moved between the first and second sash positions, said means for providing including means for maintaining a linear relationship between the air flow signal and the air flow through the hood;*

*a pressure sensor located in the exhaust ducting for measuring pressure and providing a pressure signal representative thereof;*

*means for providing a reference signal representative of a reference pressure level; and*

*means, responsive to the reference signal and to the pressure signal, for controlling the air flow provided by the exhaust blower so as to maintain a relatively constant pressure at the pressure sensor.*

*28. A fume hood controller for controlling the air flow through a fume hood to maintain a relatively constant face velocity through a fume hood opening as the fume hood sash is moved to vary the size of the opening, comprising:*

*transducer means responsive to the position of the fume hood sash for producing a sash opening signal, the value of which is a substantially continuous and monotonic function of the sash opening;*

*air flow control means responsive to a first air flow signal, for varying the air flow through the fume hood in accordance with such air flow signal;*

*flow control means responsive to the sash opening signal for producing a second air flow signal, including means for setting a minimum air flow at a first sash position, said first sash position being a position wherein the sash is less than fully closed, and means for setting a second greater air flow at a second sash position; and*

*means for changing the air flow as a substantially linear function of sash opening as the sash moves between the first position and the second position, and for maintaining the air flow at said minimum air flow when the sash is below the first position, said means including means for providing the first air flow signal to the air flow control means, the first air flow signal having a value so as to maintain the air flow through the hood substantially proportional to the sash opening area as the sash is moved between the first and second sash positions, said means for providing including means for maintaining a linear relationship between the second air flow signal and the air flow through the hood.*

*29. A fume hood controller for controlling the air flow through a fume hood to maintain a relatively constant face velocity through a fume hood opening as the fume hood sash is moved comprising:*

*transducer means responsive to the position of the fume hood sash for producing a sash opening signal the value of which is a substantially continuous and monotonic function of the sash opening;*

*an exhaust blower driven by a blower motor and connected to the fume hood via exhaust ducting;*

*motor control means responsive to an air flow signal for varying the speed of the blower motor to control the air flow through the fume hood in accordance with the air flow signal;*

*sensor means located in the air flow between the fume hood and the exhaust blower for providing a control signal representative of air flow through the hood; and*

*flow control means for generating said air flow signal, said flow control means including means responsive to the control signal for increasing the blower motor speed when the control signal drops below a predetermined minimum level, means responsive to the sash opening signal for producing said control signal, said means including means for setting a first air flow at a first sash position, means for setting a second air flow at a second sash position, and means for providing the air flow signal having a value so as to maintain the air flow through the hood substantially proportional to the sash opening area as the sash is moved between the first and second sash positions, said means for providing including means for maintaining a linear relationship between the air flow signal and the air flow through the hood.*

*30. In a fume hood installation having a plurality of fume hoods each including a sash which moves to provide an opening for access to the fume hood interior; an exhaust blower driven by a blower motor; and exhaust ducting connecting each of the fume hoods to the blower; a fume hood controller, comprising:*

*a plurality of transducer means, equal in number to the number of fume hoods and each transducer being associated with a respective one of the fume hoods, each for producing a respective sash opening signal the value of which is a substantially continuous and monotonic function of the associated sash opening;*

*a plurality of flow control means, each associated with a respective one of the transducer means and responsive to the sash opening signal therefrom, for producing a first air flow signal representative of a desired air flow through the associated hood, the air flow signal being a function of the sash opening signal, each flow control means including means for setting a first air flow at a first sash position, and means for setting a second air flow at a second sash position;*

*a plurality of air flow control means, each associated with a respective one of the fume hoods and responsive to a second air flow signal, for controlling the air flow through the associated fume hood so that it varies in accordance with the second air flow signal;*

*means for providing, to each air flow control means, a second air flow signal having a value so as to maintain the air flow through the corresponding hood substantially proportional to the sash opening area for the hood as the sash is moved between the first and second sash positions, said means for providing including means for maintaining a linear relationship between the first air flow signal and the air flow through the hood;*

*means for scaling each of the sash opening signals by a scale factor reflecting the proportionality of the air flow through the associated hood to the total air flow through the exhaust blower;*

*means, responsive to the sash opening signals from each transducer means, for providing a combined sash signal which is proportional to the sum of the sash opening signals; and*

*means responsive to the combined sash signal for controlling the total air flow provided by the exhaust blower.*

*31. In a fume hood installation having a plurality of fume hoods each including a sash which moves to provide an opening for access to the fume hood interior; an exhaust blower driven by a blower motor; and exhaust ducting connecting each of the fume hoods to the blower; a fume hood controller, comprising:*

*a plurality of transducer means, equal in number to the number of fume hoods and each transducer being associated with a respective one of the fume hoods, each for producing a respective sash opening signal the value of which is a substantially continuous and monotonic function of the associated sash opening;*

*a plurality of flow control means, each associated with a respective one of the transducer means and responsive to the sash opening signal therefrom, for producing a first air flow signal representative of a desired air flow through the associated hood, the first air flow signal being a function of the sash opening signal, each flow control means including means for setting a first air flow at a first sash position, and means for setting a second air flow at a second sash position;*

*a plurality of air flow control means, each associated with a respective one of the fume hoods and responsive to a second air flow signal, for controlling the air flow through the associated fume hood so that it varies in accordance with the second air flow signal;*

*means for providing, to each air flow control means, the corresponding second air flow signal having a value so as to maintain the air flow through the corresponding hood substantially proportional to the sash opening area for the hood as the sash is moved between the first and second sash positions, said means for providing including means for maintaining a linear relationship between the first air flow signal and the air flow through the hood;*

*a pressure sensor located in the exhaust ducting for measuring pressure and providing a pressure signal representative thereof;*

*means for providing a reference signal representative of a reference pressure level; and*

*means, responsive to the reference signal and to the pressure signal, for controlling the air flow provided by the exhaust blower so as to maintain a relatively constant pressure at the pressure sensor.*

* * * * *